US011754260B2

(12) United States Patent
Gordin et al.

(10) Patent No.: US 11,754,260 B2
(45) Date of Patent: Sep. 12, 2023

(54) APPARATUS, METHOD, AND SYSTEM FOR PRECISE LED LIGHTING

(71) Applicant: Musco Corporation, Oskaloosa, IA (US)

(72) Inventors: Myron Gordin, Oskaloosa, IA (US); Nathan E. Herz, Lovilla, IA (US); Kenneth G. Lewis, Jr., New Sharon, IA (US); Chris P. Lickiss, Newton, IA (US); Luke C. McKee, Oskaloosa, IA (US); Philip D. Hol, New Sharon, IA (US); Joel D. Deboef, New Sharon, IA (US)

(73) Assignee: Musco Corporation, Oskaloosa, IA (US)

( * ) Notice: Subject to any disclaimer, the term of this patent is extended or adjusted under 35 U.S.C. 154(b) by 149 days.

(21) Appl. No.: 17/304,673

(22) Filed: Jun. 24, 2021

(65) Prior Publication Data

US 2022/0010944 A1 Jan. 13, 2022

Related U.S. Application Data

(60) Provisional application No. 63/050,476, filed on Jul. 10, 2020.

(51) Int. Cl.
*F21V 14/04* (2006.01)
*F21V 29/76* (2015.01)
(Continued)

(52) U.S. Cl.
CPC ..... *F21V 14/04* (2013.01); *F21S 8/08* (2013.01); *F21V 3/02* (2013.01); *F21V 5/002* (2013.01);
(Continued)

(58) Field of Classification Search
CPC ..... F21V 14/02; F21V 14/04; F21V 5/002; F21V 5/04; F21S 8/08; F21S 8/085;
(Continued)

(56) References Cited

U.S. PATENT DOCUMENTS 1,176,475 A 3/1916 McPherson
1,560,948 A 3/1924 Smothers
(Continued)

FOREIGN PATENT DOCUMENTS

EP 1424363 B1 2/2007
WO 2011087543 A1 7/2011

OTHER PUBLICATIONS

Abrisa Technologies, Application Note: First Surface Mirrors Jan. 28, 2016.

(Continued)

*Primary Examiner* — Bryon T Gyllstrom
(74) *Attorney, Agent, or Firm* — Kurt J. Fugman; Mark D. Hansing

(57) ABSTRACT

Lighting applications which are particularly difficult to light because of "non-standard" target areas (or otherwise) would benefit from advancements in lighting design. That being said, conventional wisdom in lighting design has practical limitations—conventional means of visors at/on lighting fixtures (i.e., local visoring) can only become so long to provide beam cutoff before becoming prohibitively heavy or costly, for example. Local visoring can only be pivoted so far before beam shift occurs (e.g., shifting the physical location of maximum candela or photometric center), as another example. Conventional wisdom can only buy so much cutoff and beam control before the overall lighting design is impacted—and so an alternative approach is warranted. One such alternative approach which relies upon a
(Continued)

combination of remote visoring and local visoring is discussed; additional approaches are also discussed.

25 Claims, 42 Drawing Sheets

(51) Int. Cl.

| | |
|---|---|
| ***F21V 3/02*** | (2006.01) |
| ***F21V 5/00*** | (2018.01) |
| ***F21S 8/08*** | (2006.01) |
| ***F21V 5/04*** | (2006.01) |
| ***F21Y 115/10*** | (2016.01) |

(52) U.S. Cl.
CPC ..... *F21V 5/04* (2013.01); *F21V 29/763* (2015.01); *F21Y 2115/10* (2016.08)

(58) Field of Classification Search
CPC F21S 8/086; F21S 8/088; F21S 13/10; F21W 2131/10; F21W 2131/105
See application file for complete search history.

(56) References Cited

U.S. PATENT DOCUMENTS

| | | | | |
|---|---|---|---|---|
| 1,751,111 | A | 8/1928 | Steele et al. | |
| 4,337,506 | A | 6/1982 | Terada | |
| 4,388,678 | A | 6/1983 | Turner | |
| 5,647,661 | A | 7/1997 | Gordin et al. | |
| 5,887,969 | A | 3/1999 | Gordin | |
| 5,906,425 | A | 5/1999 | Gordin et al. | |
| 6,220,726 | B1 | 4/2001 | Gordin | |
| 7,500,764 | B2 * | 3/2009 | Gordin | F21S 8/085 362/431 |
| 7,703,951 | B2 | 4/2010 | Piepgras et al. | |
| 7,828,465 | B2 | 11/2010 | Roberge et al. | |
| 8,789,967 | B2 * | 7/2014 | Gordin | F21V 14/00 362/223 |
| 9,964,267 | B1 * | 5/2018 | Van Ee | F21V 21/28 |
| 2008/0080162 | A1 | 4/2008 | Wilcox et al. | |
| 2008/0278941 | A1 | 11/2008 | Logan et al. | |
| 2011/0149582 | A1 | 6/2011 | McKee | |
| 2011/0227487 | A1 | 9/2011 | Nichol et al. | |
| 2012/0217897 | A1 * | 8/2012 | Gordin | F21V 5/04 315/294 |
| 2012/0307486 | A1 | 12/2012 | Gordin et al. | |
| 2013/0250556 | A1 | 9/2013 | Gordin et al. | |
| 2014/0340889 | A1 | 11/2014 | Gordin | |

OTHER PUBLICATIONS

Musco Corporation, PCT/US2018/036111 filed Jun. 5, 2018, "The International Search Report and the Written Opinion of the International Searching Authority, or the Declaration", dated Sep. 19, 2018.

International Searching Authority in connection with PCT/US2021/038814 filed Jun. 24, 2021, "The International Search Report and The Written Opinion of the International Searching Authority, or the Declaration", 14 pages, dated Oct. 14, 2021.

* cited by examiner

Detail A

Detail B

Detail C

Detail D

APPARATUS, METHOD, AND SYSTEM FOR PRECISE LED LIGHTING

CROSS-REFERENCE TO RELATED APPLICATIONS

This application claims priority under 35 U.S.C. § 119 to provisional U.S. application Ser. No. 63/050,476, filed Jul. 10, 2020 hereby incorporated by reference in its entirety.

TECHNICAL FIELD OF INVENTION

The present invention generally relates to means of providing precise LED lighting for difficult to light or "non-standard" target areas such as turns in a racetrack. More specifically, the present invention relates to apparatus, method, and system of increasing sharpness of cutoff and overall beam control via adjustable local and/or remote visoring to not only provide said benefits of increasing sharpness of cutoff and beam control, but in a manner that avoids undesirable beam shift.

BACKGROUND OF THE INVENTION

It is well known in the art of lighting design that there are certain applications where the target area is difficult to light; for example, mounting heights and pole setback are undesirable, target areas are complex in shape, lighting uniformity is high, and the like. Many of these applications—such as racetrack lighting—have several of these complications all at one site, and have the added complexity of restrictions on upstream lighting to preserve drivability; see, for example, U.S. Pat. No. 8,517,566 incorporated by reference herein in its entirety for further explanation. These more demanding applications typically require, as compared to general purpose lighting, sharper cutoff (e.g., a smaller angle over which light transitions from its maximum candela value (or photometric center) to nearly imperceptible) so to place light on the target area but cut it off at a desired point (e.g., before light hits the eyes of spectators in the stands), as well as increased beam control (i.e., directing a composite beam to an aiming point within a certain degree of accuracy, and without significant glare or spill light).

Conventional wisdom in lighting design suggests that a combination of light directing means (i.e., means which primarily collimate or otherwise guide light in a particular direction generally aligned with an aiming axis—such as secondary lenses or knuckles or even diffusers) and light redirecting means (i.e., means which primarily terminate or redirect in a different direction light already traveling in a particular direction—such as light blocks, louvers, or visors) in and at a lighting fixture may be tailored to provide a necessary sharpness of cutoff and beam control—but conventional wisdom has its limits. For example, visors at/on lighting fixtures (i.e., local visoring) can only become so long to sharpen beam cutoff before they before prohibitively heavy or costly. Said local visoring can only be pivoted so far before beam shift occurs (i.e., shifting the physical location of maximum candela or photometric center or other defined value) and beam control is lost. Conventional wisdom can only buy so much cutoff and beam control before the overall lighting design is impacted; therefore, an alternative approach is warranted to provide the sort of precise lighting needed for difficult to light or "non-standard" target areas.

U.S. Pat. No. 10,378,732 incorporated by reference herein in its entirety discusses one such alternative approach wherein a combination of local visoring and remote visoring is used to increase sharpness of cutoff and beam control via use of differential reflection (e.g., via second surface mirrors). That being said, more can be done; namely, in (i) addressing retrofit situations that may require pole mounting, (ii) situations requiring a density of light or compacted space such that stacked fixtures may be needed, and (iii) situations that may require some degree of uplight. Further, second surface mirrors can be difficult to handle and install—glass mirror material can be sharp and fragile (and too costly to temper and/or coat), which can pose a hazard when sliding into and out of the apparatuses described in U.S. Pat. No. 10,378,732—and so more can be done to develop sharpness of cutoff and beam control with mirror material incorporated in local visoring in a manner that avoids or minimizes these undesirable effects.

Thus, there is room for improvement in the art.

SUMMARY OF THE INVENTION

As is well known in the art of lighting design, difficult to light applications and non-standard target areas such as those with undesirable mounting heights and pole setbacks, complex target area shapes, and high lighting uniformity require complicated lighting designs wherein the target area is mapped out in a virtual space in lighting design software with some number of virtual lighting fixtures each of which is carefully aimed to a point on the virtual target area so to precisely build up a virtual lighting design which, in practice, corresponds to an actual lighting design. If executed correctly, the actual lighting design is one or more composite beams (resulting from a layering of lighting from each light source), the sum of which meets all the uniformity, intensity, cutoff, and overall lighting needs of the application; see, for example, U.S. Pat. No. 7,500,764 incorporated by reference herein in its entirety for further explanation.

As can be appreciated, the success of an actual lighting design meeting the needs of a site depends upon it matching closely with the virtual lighting design which depends on the photometry in the software matching the light produced by the actual lighting fixtures. However, when conventional wisdom is used with conventional means to meet the needs of these difficult to light or non-standard target areas, certain detrimental lighting effects can occur. For example, a tight turn on a racetrack might necessitate a sharp cutoff which might necessitate pivoting a lighting fixture visor past a recommended limit which might result in a beam shift—which might result in the lighting design not meeting spec. In essence, conventional wisdom and conventional means in the art of lighting design have practical limitations.

It is therefore a principle object, feature, advantage, or aspect of the present invention to improve over the state of the art and/or address problems, issues, or deficiencies in the art.

According to one aspect of the present invention are apparatus, method and system for combining light directing and/or light redirecting means at or near the lighting fixture (i.e., local means) with remote light redirecting means which are operatively connected to the lighting fixtures in a manner that is not prohibitively heavy or costly so to collectively provide precise LED lighting via increased sharpness of cutoff and/or beam control.

According to another aspect of the present invention are apparatus, method and system for combining light directing and/or light redirecting means at or near the lighting fixture (i.e., local means) with additional local means (at least some of which are adjustable in situ) produced according to aspects of the present invention so to collectively provide precise LED lighting via increased sharpness of cutoff and/or beam control.

Further objects, features, advantages, or aspects of the present invention may include one or more of the following:

a. apparatus, method, and system for providing remote visoring in operative connection with, but physically separated from, local visoring in one or more arrays of lighting fixtures;
b. apparatus, method, and system for uniform adjustment of said remote visoring across an array of lighting fixtures while also permitting (i) individual adjustment of the associated local visoring and, if desired, (ii) individual adjustment of at least some portions of the remote visoring;
c. apparatus, method, and system for providing selectable beam cutoff and/or beam control via design and/or material selection of local visoring and/or local light directing means (e.g., secondary lens, diffusers);
d. apparatus, method, and system for uniform and non-uniform adjustment of said local visoring and/or light directing means;
e. apparatus, method, and system for pole mounting precise LED lighting fixtures designed according to aspects of the present invention; and
f. apparatus, method, and system for stacking multiple arrays of precise LED lighting fixtures designed according to aspects of the present invention on a common infrastructure (e.g., pole).

These and other objects, features, advantages, or aspects of the present invention will become more apparent with reference to the accompanying specification and claims.

BRIEF DESCRIPTION OF THE DRAWINGS

From time-to-time in this description reference will be taken to the drawings which are identified by figure number and are summarized below.

FIG. 39A illustrates an assembled view and FIG. 39B illustrates a partially exploded view.

DETAILED DESCRIPTION OF EXEMPLARY EMBODIMENTS

A. Overview

Figure 1:
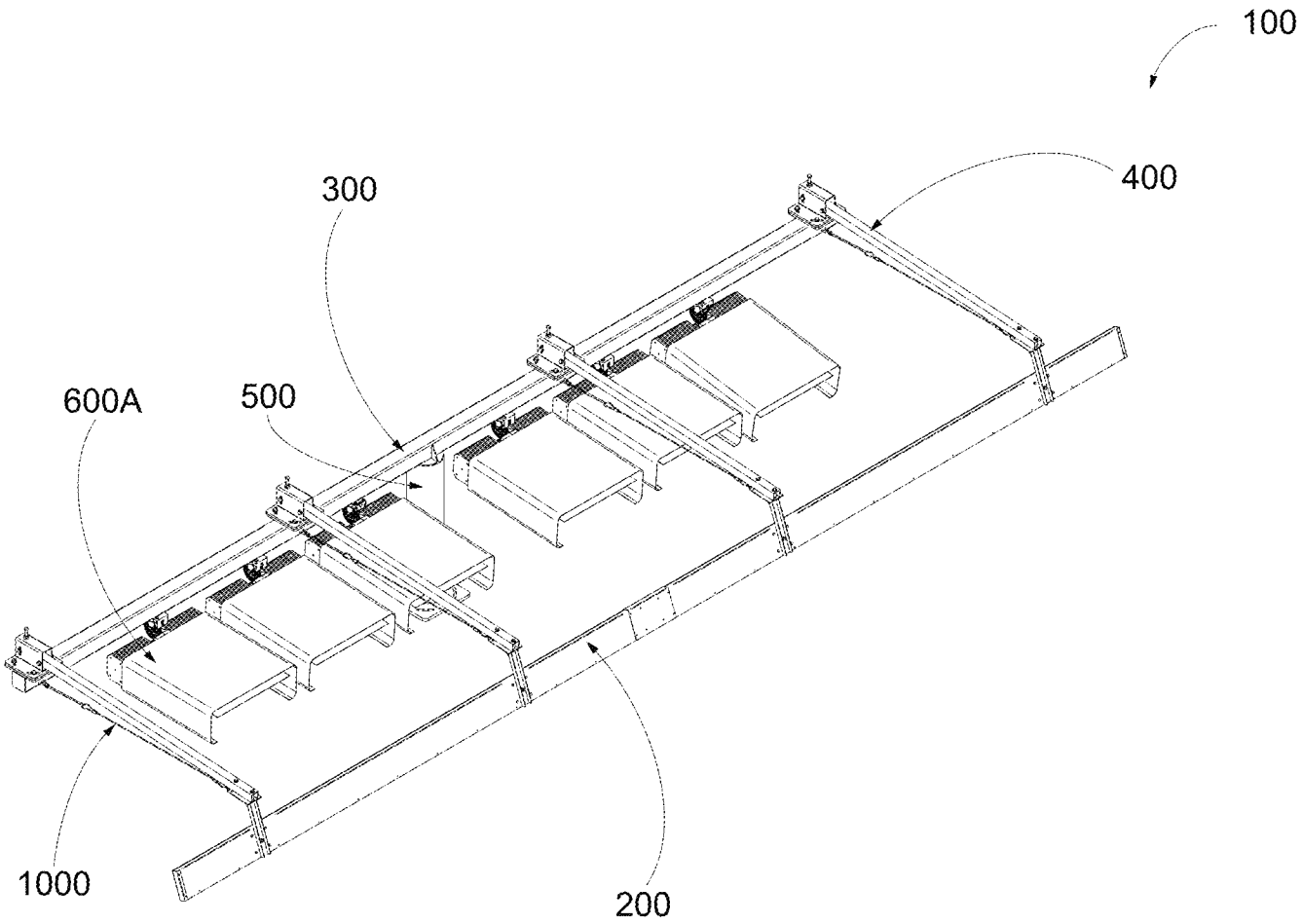
FIG. 1 illustrates a top front perspective view of a first embodiment to provide precise LED lighting according to aspects of the present invention; here, using both local and remote visoring. Note that six lighting fixtures with associated knuckles are illustrated, though this is by way of example and not by way of limitation in terms of both quantity and design.
Figure 2:
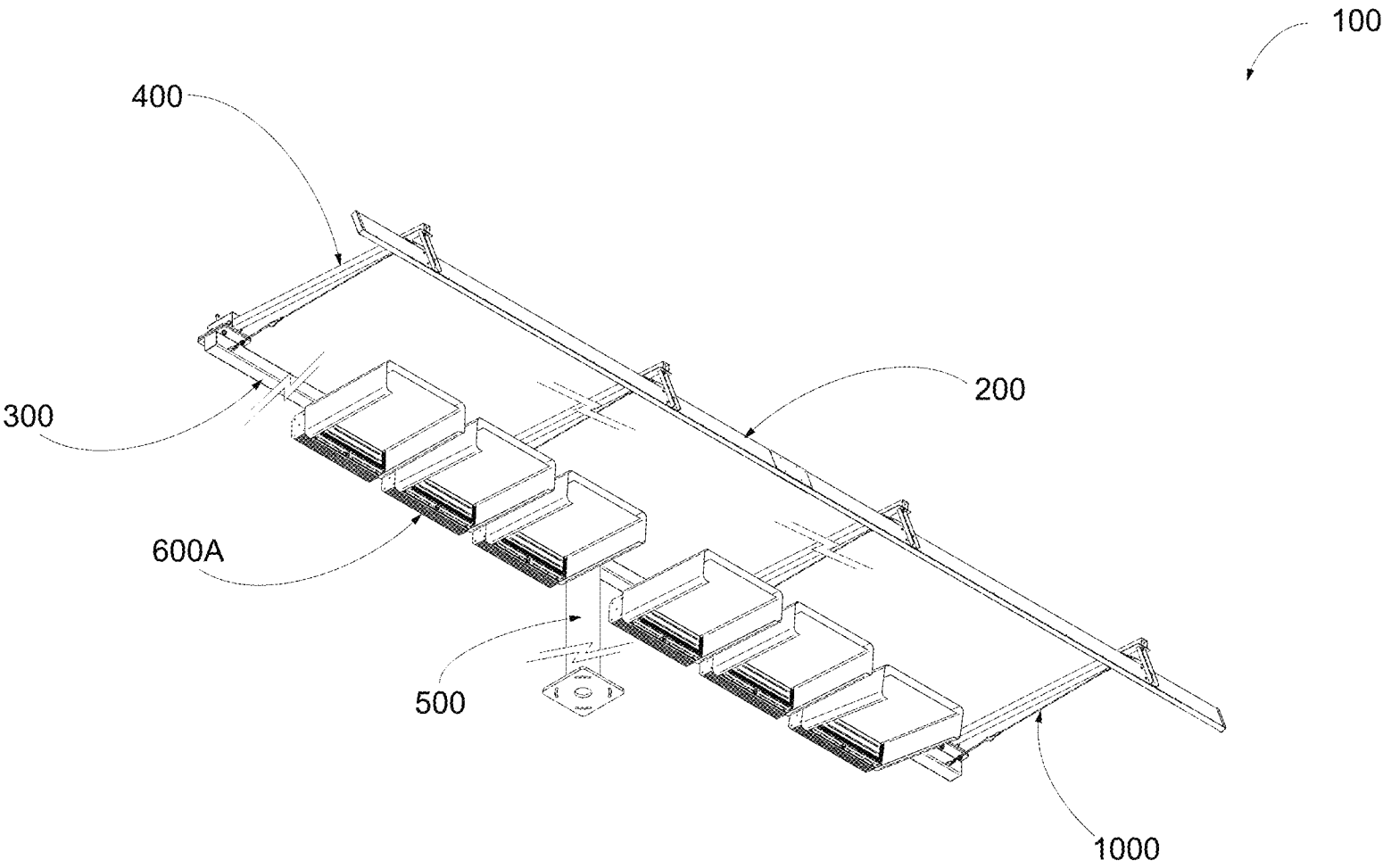
FIG. 2 illustrates a bottom front perspective view of FIG. 1; here, with double break lines indicating variable lengths. It is of note double break lines have been omitted from FIGS. 1, and 3-11 for clarity.
Figure 3:
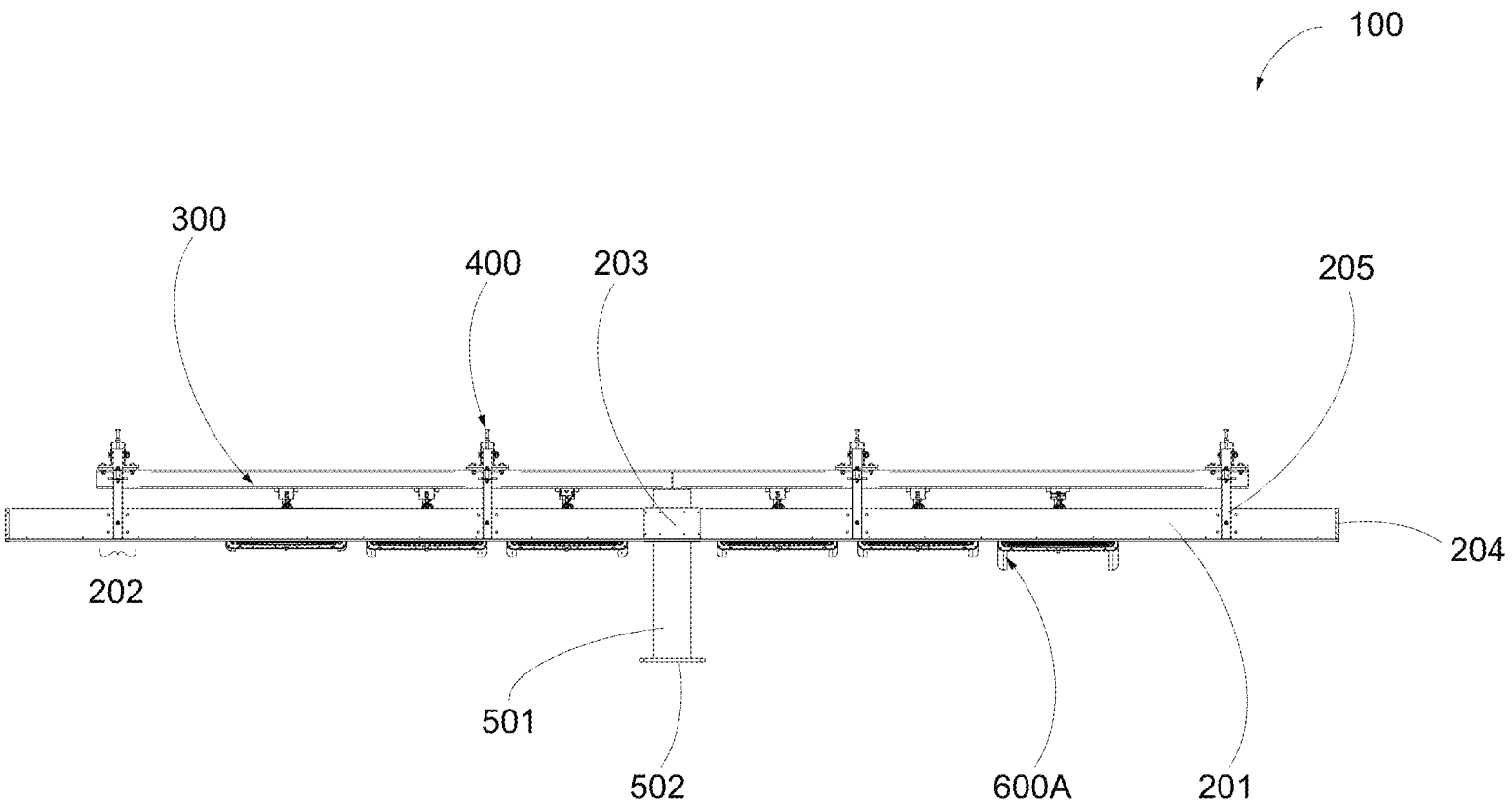
FIG. 3 illustrates a front view of FIG. 1.
Figure 4:
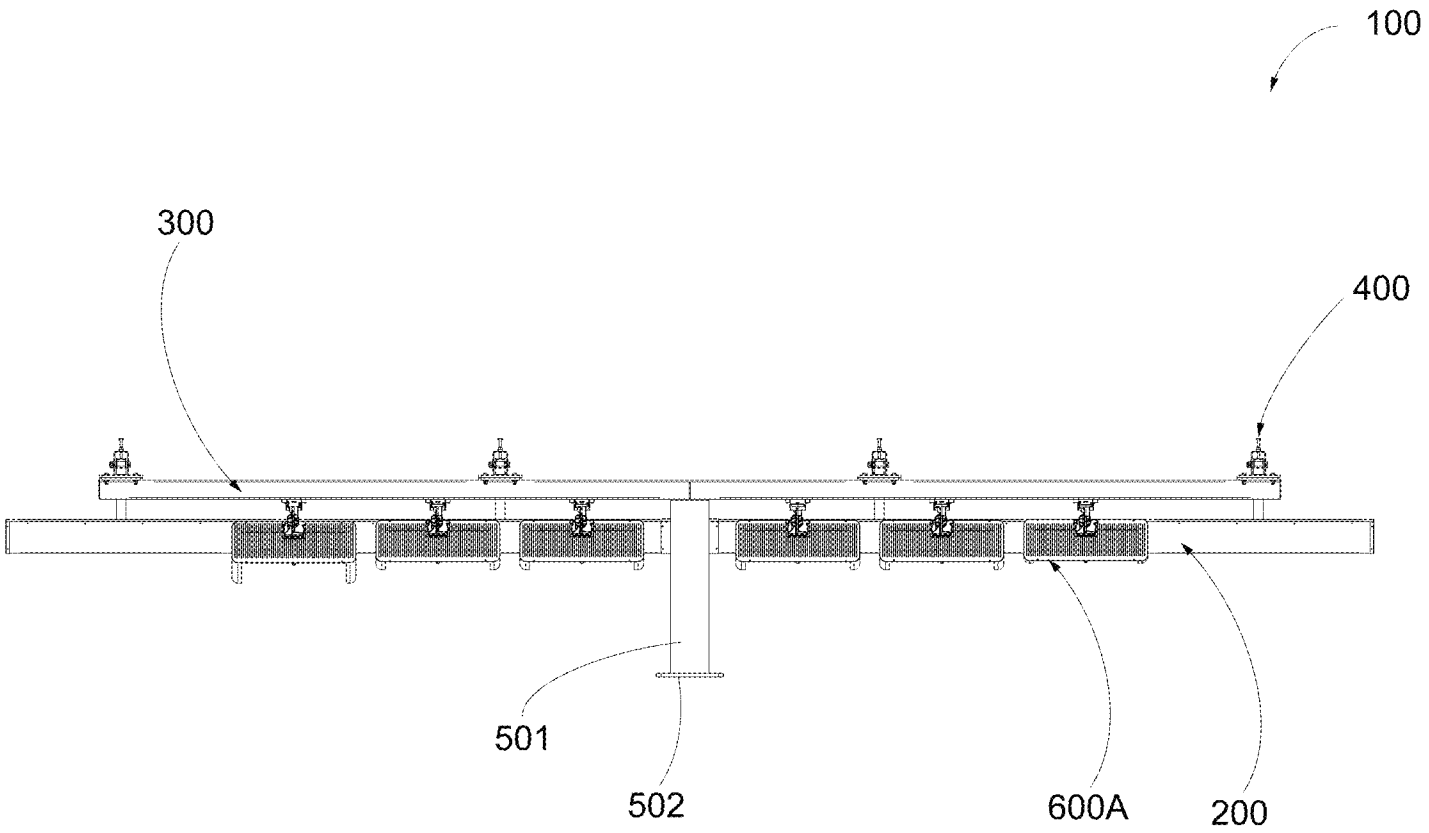
FIG. 4 illustrates a back view of FIG. 1.
Figure 5:
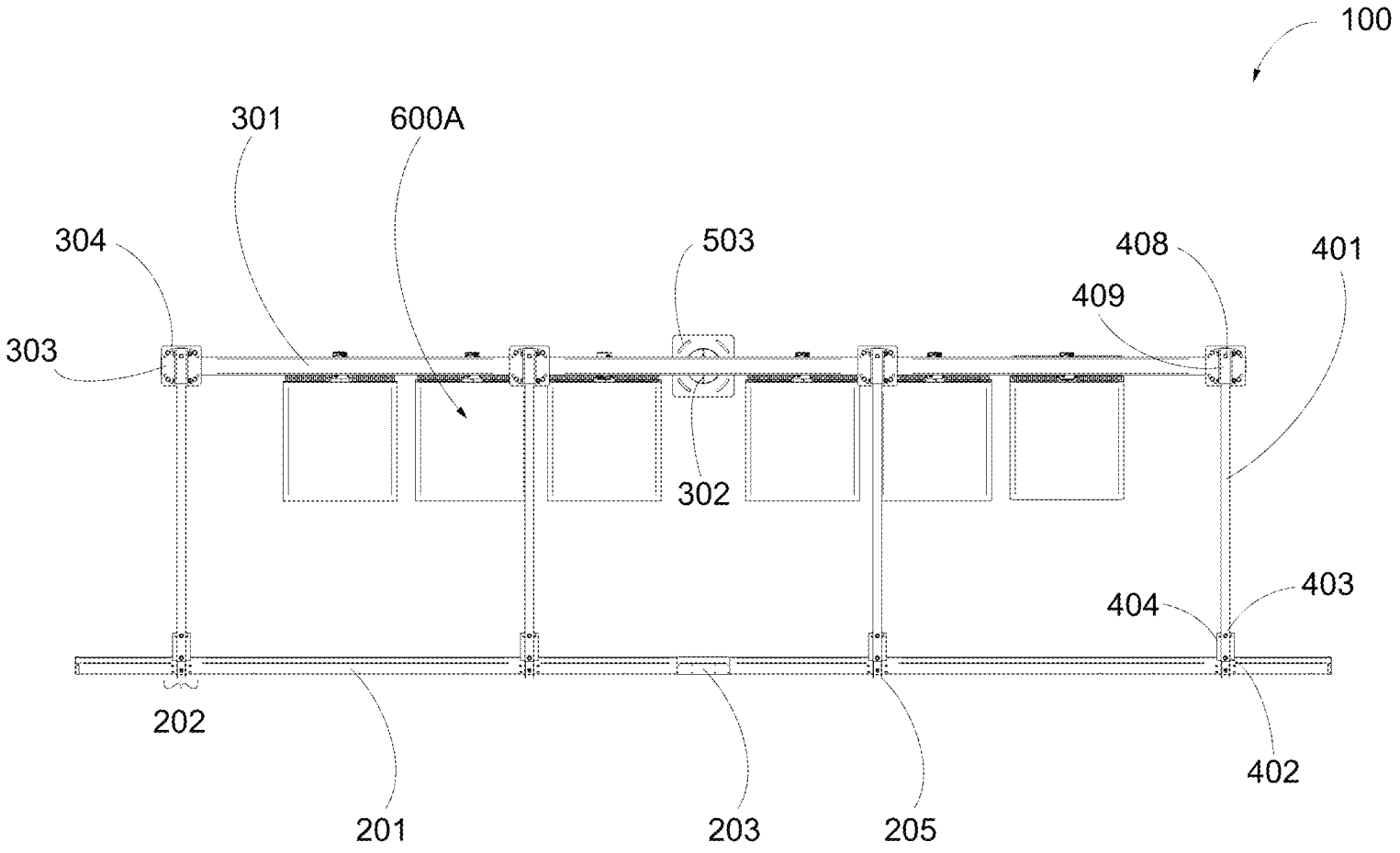
FIG. 5 illustrates a top view of FIG. 1.
Figure 6:
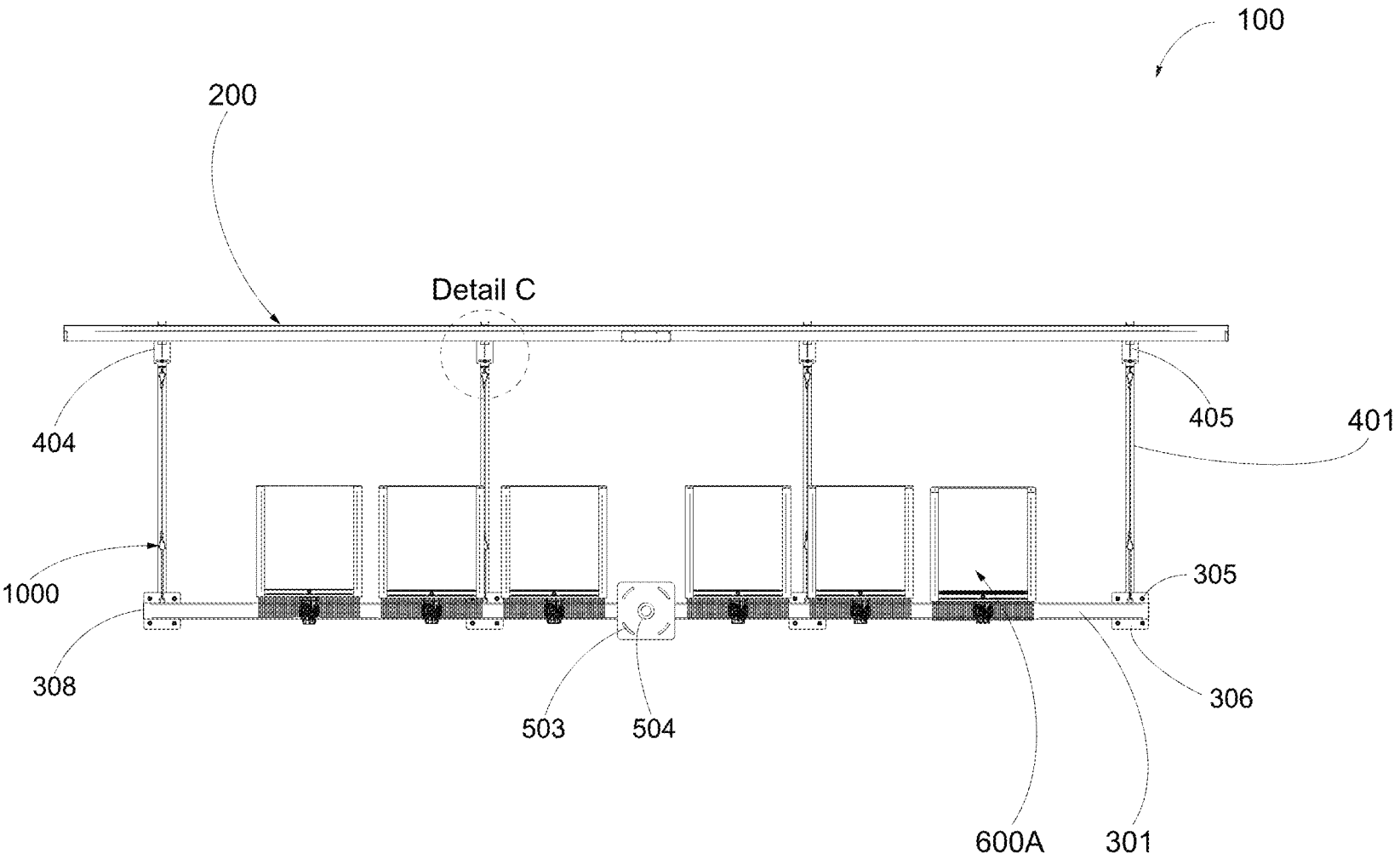
FIG. 6 illustrates a bottom view of FIG. 1.
Figure 7:
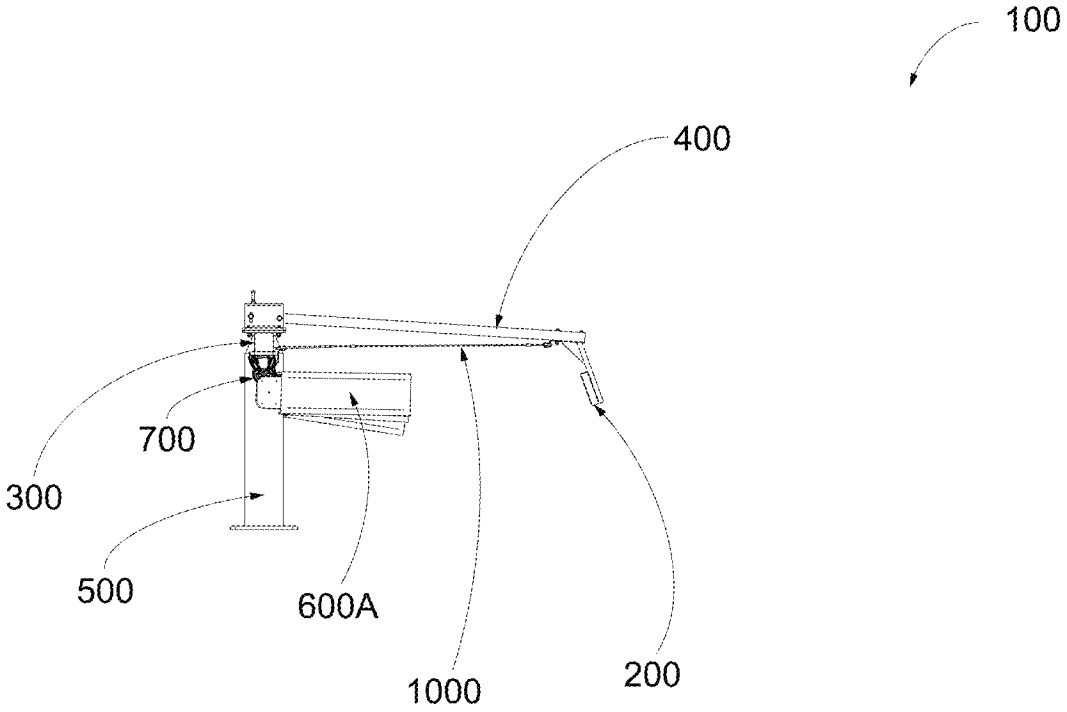
FIG. 7 illustrates a left side view of FIG. 1; here, illustrating various vertical aiming angles of lighting fixtures 600A, though this is by way of example and not by way of limitation.
Figure 8:
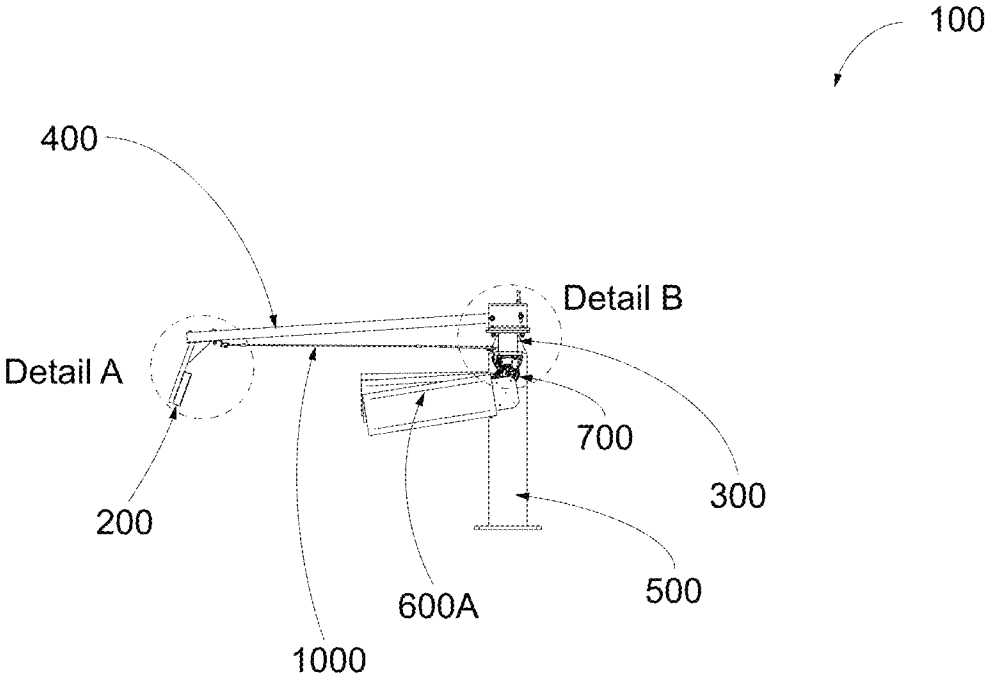
FIG. 8 illustrates a right side view of FIG. 1; here, illustrating various vertical aiming angles of lighting fixtures 600A, though this is by way of example and not by way of limitation.
Figure 9:
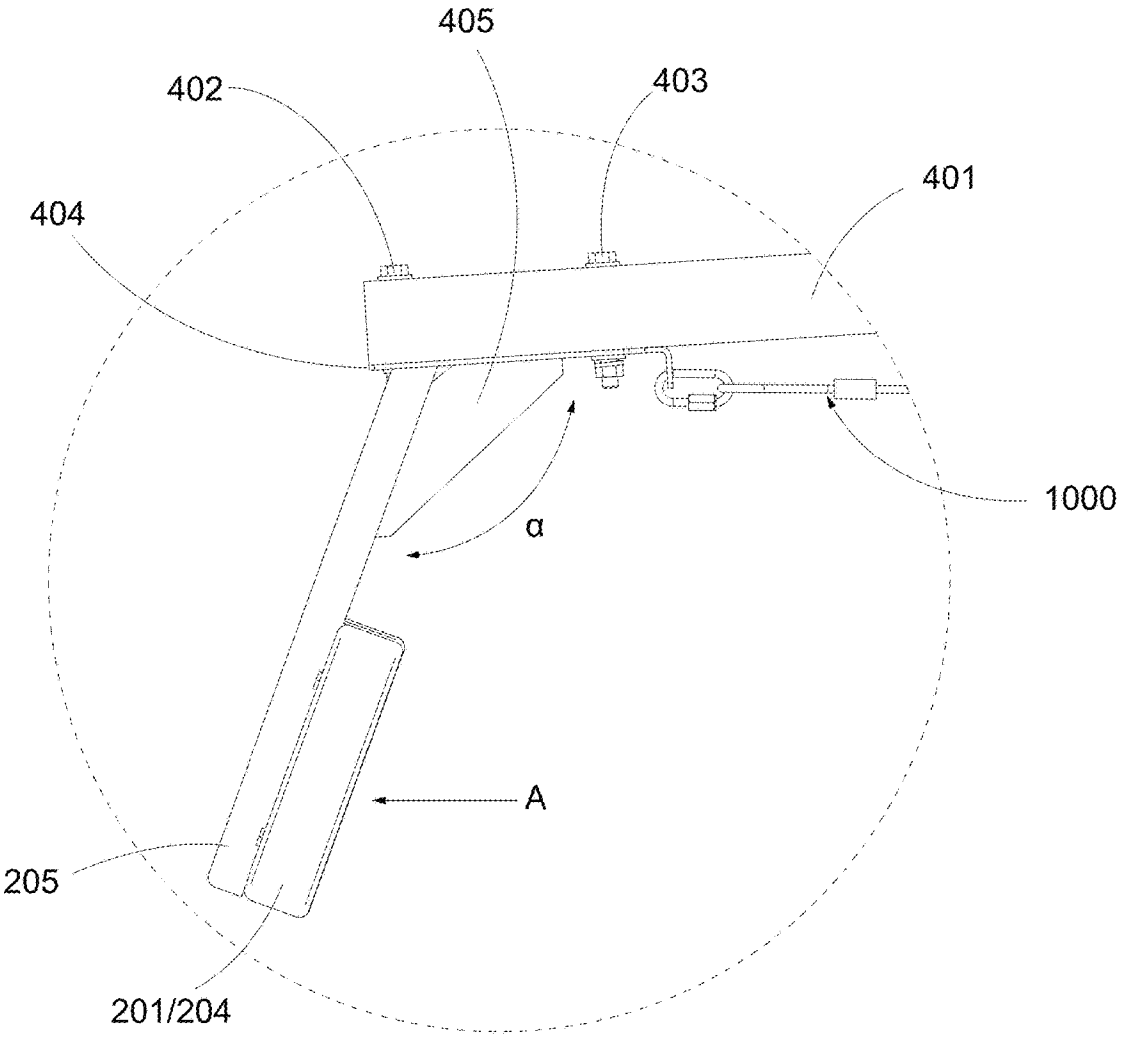
FIG. 9 illustrates an enlarged view of Detail A of FIG. 8.

To further an understanding of the present invention, specific exemplary embodiments according to the present invention will be described in detail. Frequent mention will be made in this description to the drawings. Reference numbers will be used to indicate certain parts in the drawings. Unless otherwise stated, the same reference numbers will be used to indicate the same parts throughout the drawings.

Regarding terminology, as used herein the term "cutoff" refers to the angle over which light transitions from its maximum candela value (or photometric center or other defined value) to nearly imperceptible. In this sense, a "sharper cutoff" or "increased sharpness of cutoff" refers to a smaller angler over which the aforementioned light transition occurs. The term "beam control" refers to directing a beam to an aiming point within a certain degree of accuracy, and without significant glare or spill light; here "glare" and "spill light" are terms well understood in the art of lighting design, but generally refer to undesirable light that takes away from or distracts from usable light at the target area. In this sense, "increased beam control" refers to a higher degree of accuracy, less glare, and/or less spill light. Therefore, "precise" LED lighting according to aspects of the present invention means providing sharper cutoff and/or increased beam control for an application as compared to state-of-the-art lighting.

Further regarding terminology, reference is given herein to "visor", "visors", and/or "visoring"; use of any of these terms does not necessarily restrict selection of means to those which absorb light (as opposed to those which reflect light) or to those which reflect light (as opposed to those which absorb light). As will be described in each relevant embodiment, one or more parts (which may be referred to as a visor, visors, and/or visoring) might be at least partially reflective, whereas some may be blackened or otherwise absorb light. Again, the technical solution provided by the present invention is providing precise LED lighting without significant glare and/or spill light and/or beam shift—this can be achieved with a variety of local means, remote means, reflective means, and absorbing means, any of which may be combined, and all of which might be referred to as visor, visors, or visoring.

Further regarding terminology, the term "beam shift" refers to shifting the physical location of maximum candela or photometric center (or other defined value) of a beam as compared to where it is intended to exist with respect to the larger composite beam. "Composite beam" is a term well understood in the art of lighting design, but generally it is to be understood that when a lighting fixture has multiple light sources (like in an LED lighting fixture) each fixture projects a composite beam which is, in essence, the composite of individual beams from each light source (usually overlaid or layered or otherwise designed to blend together). This is likewise true for overall lighting designs; a target area is lit by a composite beam in the sense that most target areas are lit by multiple lighting fixtures (each of which could have a single light source or multiple light source) in the same manner—light is overlaid, layered, or otherwise blended to build up uniformity and light levels. So use of the term "composite beam" should be considered in a manner consistent with its use herein. Lastly with respect to lighting terms, the term "uplight" refers to the lighting of a 3D space above or otherwise separate from a 2D plane and considered a part of a larger target area including both the 3D space and the 2D plane. With respect to all of the aforementioned, it can be appreciated that (i) no limitations which depart from common knowledge in lighting design should be imported into the use of these terms unless explicitly stated herein, and (ii) the exemplary embodiments set forth examples of values or ranges of what is achievable according to aspects of the present invention, and use of these terms is not limited to such.

Further regarding terminology, other terms are used more or less interchangeably herein: "site" and "application"; "device", "portion", "part", and "structure"; and "lighting fixtures" and "fixtures". With respect to the aforementioned, the use of one term over the other is merely for convenience and should not be considered limiting. Also, the term "pivot" or "pivoting" is often used herein to describe adjustment of one adjustable part relative to another—particularly when adjustability is about a point; it is to be understood that "pivot" or "pivoting" is but one type of adjustability and that parts described and illustrated herein are not restricted only to means which can pivot (see, e.g., FIGS. 12A-14B which illustrate and describe multiple approaches to providing adjustability of parts). Also, the term "means" is used herein to describe parts, portions, apparatus, apparatus combined with method, and the like; it is to be understood that "means" can encompass a variety of approaches to a topic—for example, fastening means could include tape, glue, bolt-and-nut, a method of compression, etc.—and unless explicitly stated herein, no particular approach should be excluded or considered limiting.

Lastly regarding terminology, terms such as "left", "right", "pan", "tilt", "vertical", "horizontal", "up", "down", "upstream", and "downstream" are directional with respect to the specific example described and/or illustrated. It can be appreciated that each lighting application may be different and have unique needs, and so these terms may be different, be omitted, or have a different definition given the application; this is true even within a single application (e.g., in a racetrack scenario an outer side of a track (i.e., the side closest to spectators) might be upstream of a driver on one turn but downstream of a driver in another turn).

The exemplary embodiments envision apparatus, method, and system designed to deliver precise LED lighting; namely, by increasing sharpness of cutoff and/or beam control as compared to state-of-the-art lighting systems. Some embodiments discussed herein combine remote visoring (i.e., visoring that is located some physical distance away from but in operative connection with the lighting fixtures) with local visoring (i.e., visors at/on/part of lighting fixtures) to provide said precise LED lighting from a common infrastructure. This common infrastructure allows, for example, an entire span of remote visoring to be uniformly adjusted relative to the light sources of the lighting fixtures while still permitting individual adjustment of local visoring. Other embodiments discussed herein rely only on remote visoring whereas still others rely only on local visoring. All of the embodiments discussed herein rely on local light directing means (e.g., secondary lenses) in combination with LED light sources, though as later described, this could differ. A single reference number 600 denotes lighting fixtures with LED light sources with associated local light directing means, and which might encompass any, some, or all of the aforementioned local light redirecting means and remote light redirecting means with specific designs/configurations denoted by 600 followed by a letter (e.g., 600A, 600B). An additional option for light directing means—here, means for diffusing light (see FIG. 38)—could be applied to any configuration of lighting fixtures 600. Likewise, an additional option for light redirecting means—here, a side visor extension (see FIGS. 39A and B)—could be added to either side of any configuration of lighting fixtures 600 having local visoring.

Further discussed is pole mounting and/or stacked fixture designs/configurations so to address various difficult to light or non-standard target areas (e.g., retrofits, racetracks); here, "stacked" merely refers to one or more LED lighting fixtures higher, lower, or otherwise in a physically separate location than other LED lighting fixtures in the system such that separate structure is required to provide for aspects of the present invention, but also positioned in such a manner as to rely on a common infrastructure (e.g., pole).

More specific exemplary embodiments, utilizing aspects of the generalized examples described above, will now be described.

B. Exemplary Apparatus Embodiment 1

One possible system of providing increased sharpness of cutoff and/or beam control so to provide said precise LED lighting is illustrated in FIGS. 1-14B. Here, system 100 generally includes (i) a plurality of LED lighting fixtures 600 (here, a specific configuration 600A) which provides local visoring, (ii) adjustable knuckles 700 associated with said LED lighting fixtures 600A which provide adjustability in two planes (e.g., allowing panning and tilting of fixtures 600A relative a common infrastructure), (iii) a remote visor assembly 200 which provides remote visoring, and (iv) the aforementioned common infrastructure which includes a combination of crossarm assembly 300, adjustable support assembly 400, stabilizing assembly 1000, and support structure assembly 500 so to permit a combination of local visoring, remote visoring, individual adjustment, and/or uniform adjustment from a pole-mounted position.

1. LED Lighting Fixtures (600A)/Adjustable Knuckle Assembly (700)

Figure 30:
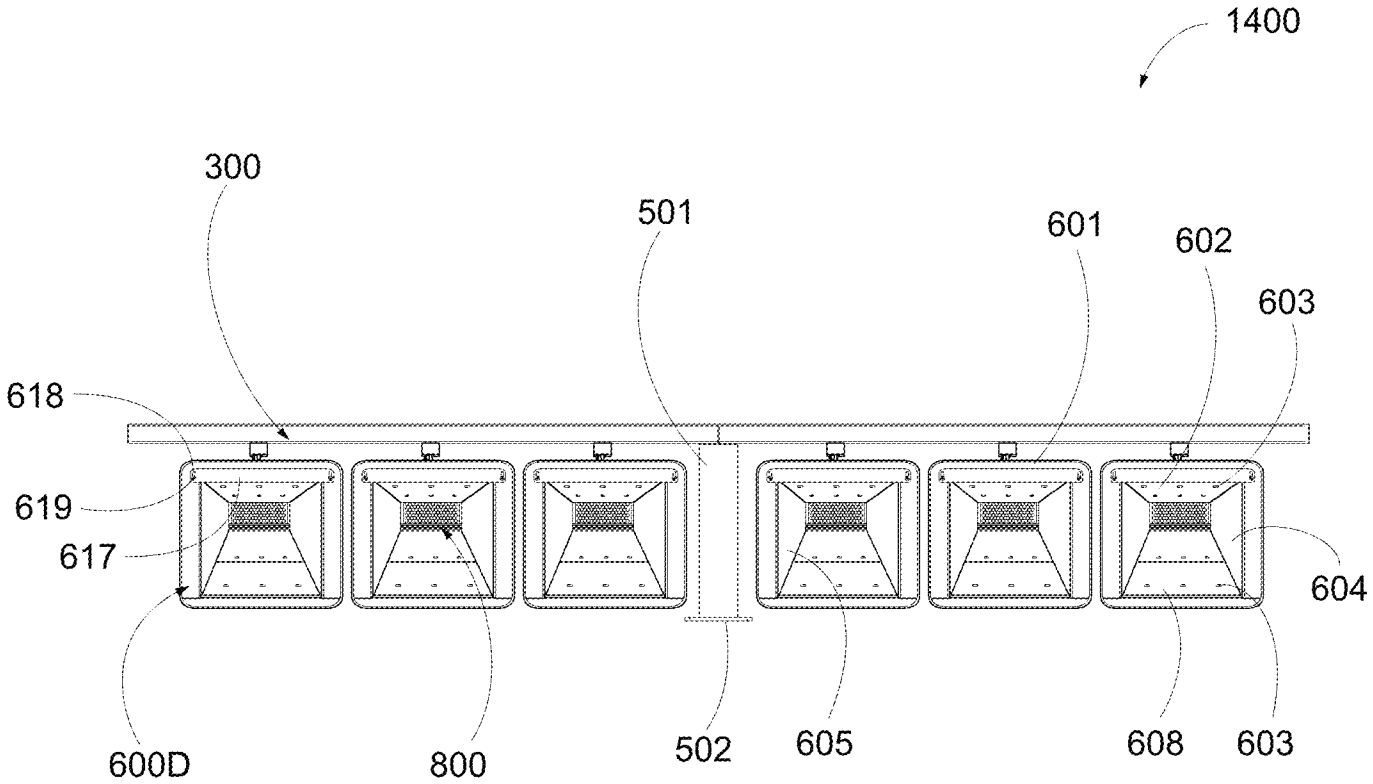
FIG. 30 illustrates a front view of FIG. 28.
Figure 31:
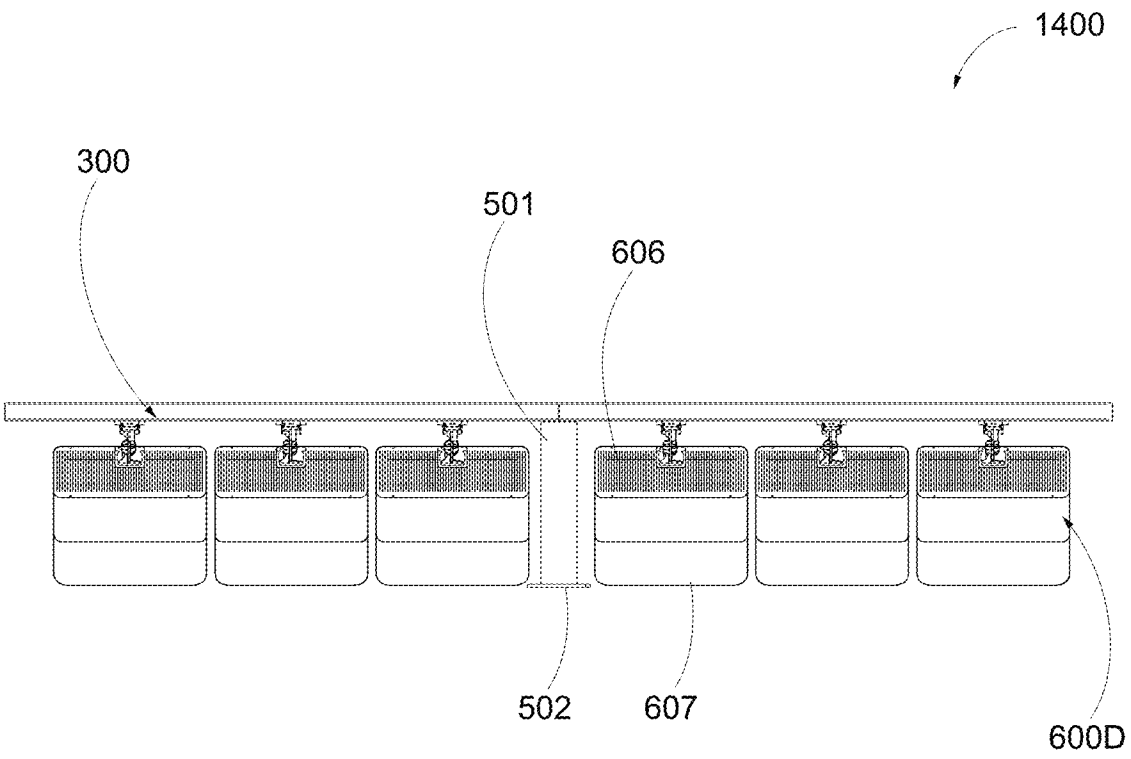
FIG. 31 illustrates a back view of FIG. 28.
Figure 32:
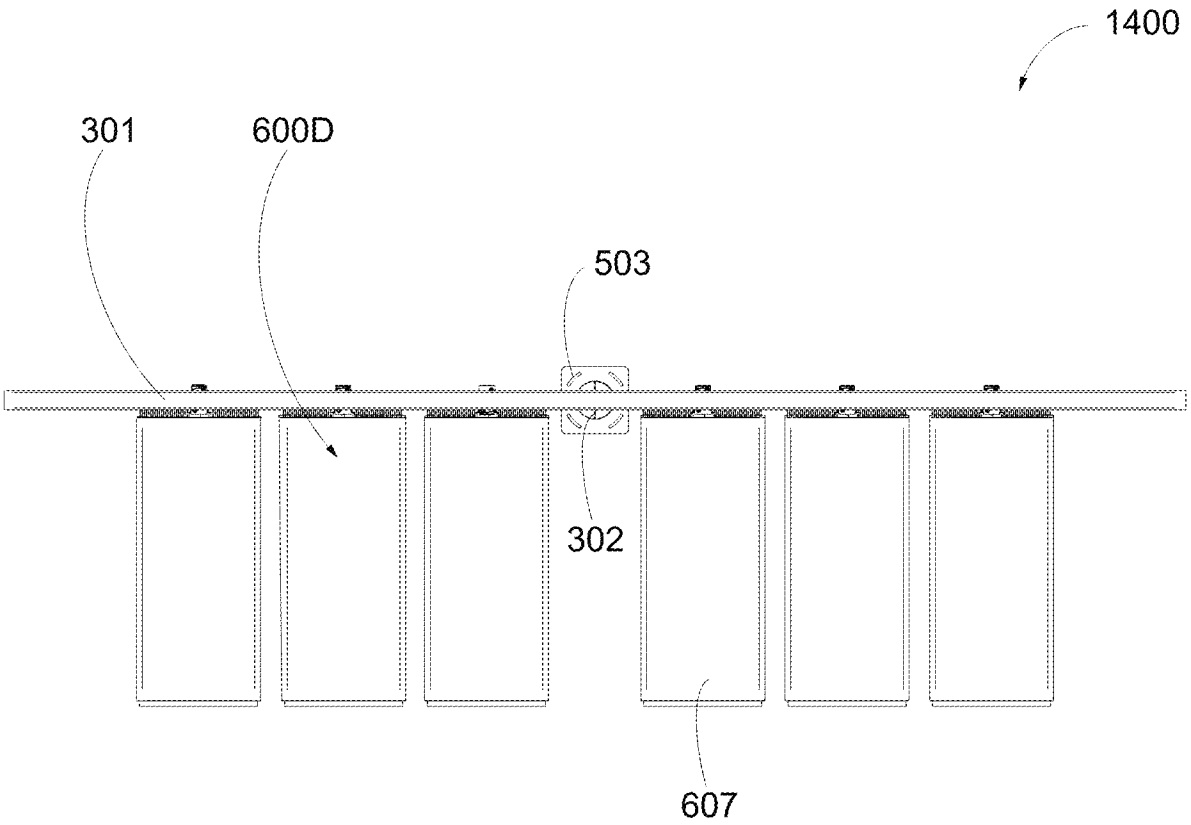
FIG. 32 illustrates a top view of FIG. 28.
Figure 33:
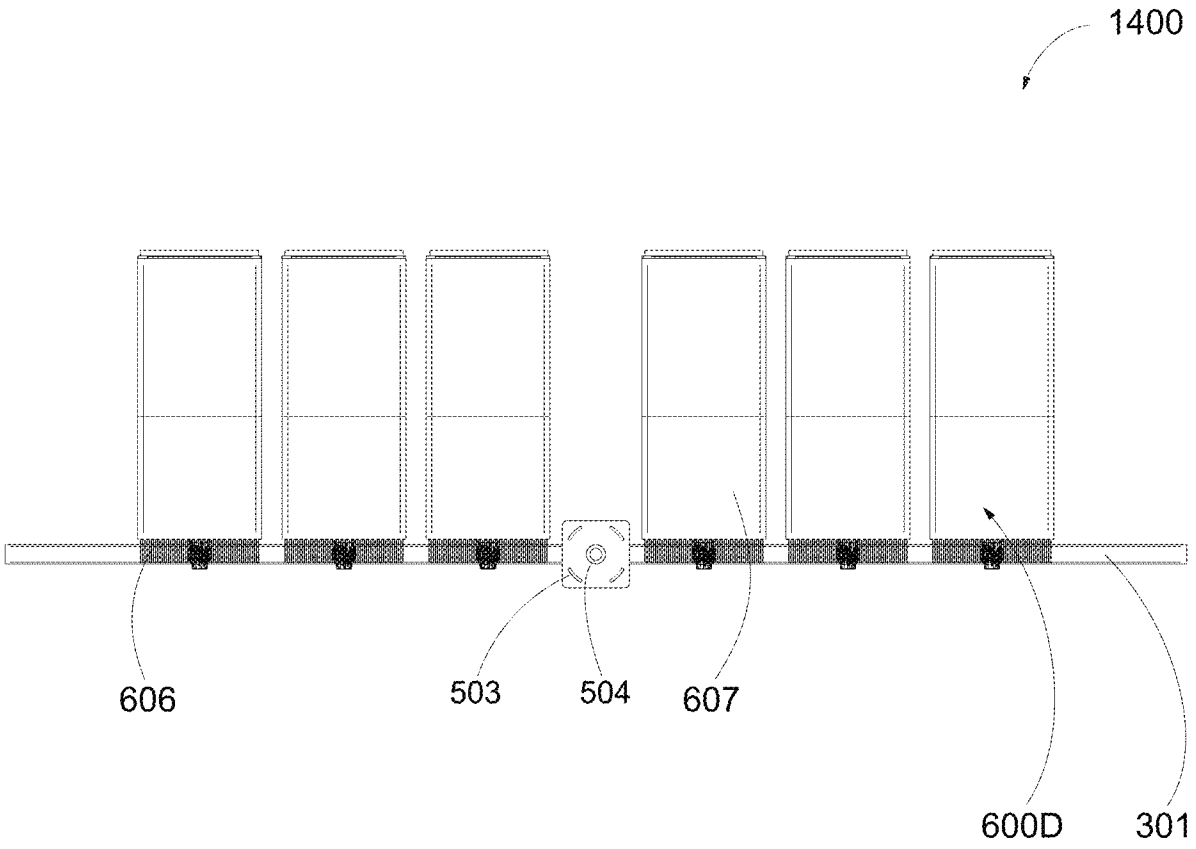
FIG. 33 illustrates a bottom view of FIG. 28.
Figure 34:
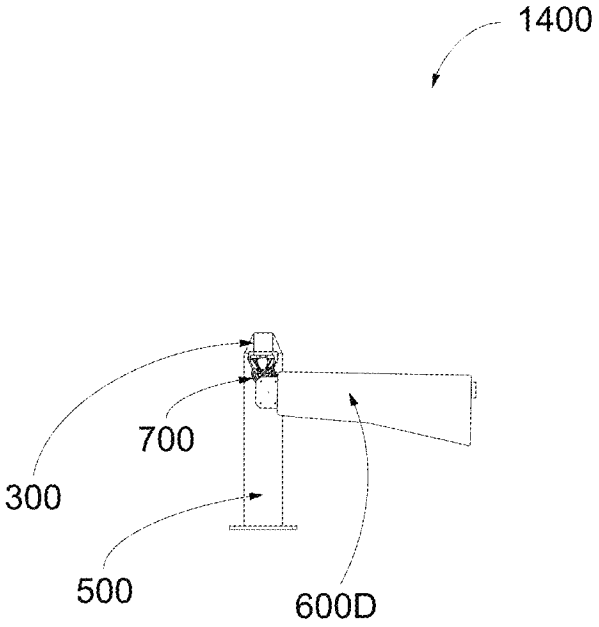
FIG. 34 illustrates a left side view of FIG. 28.
Figure 35:
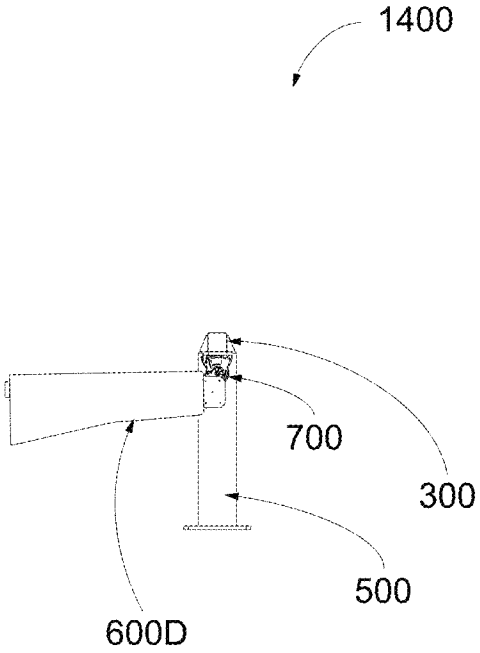
FIG. 35 illustrates a right side view of FIG. 28.
Figure 36:
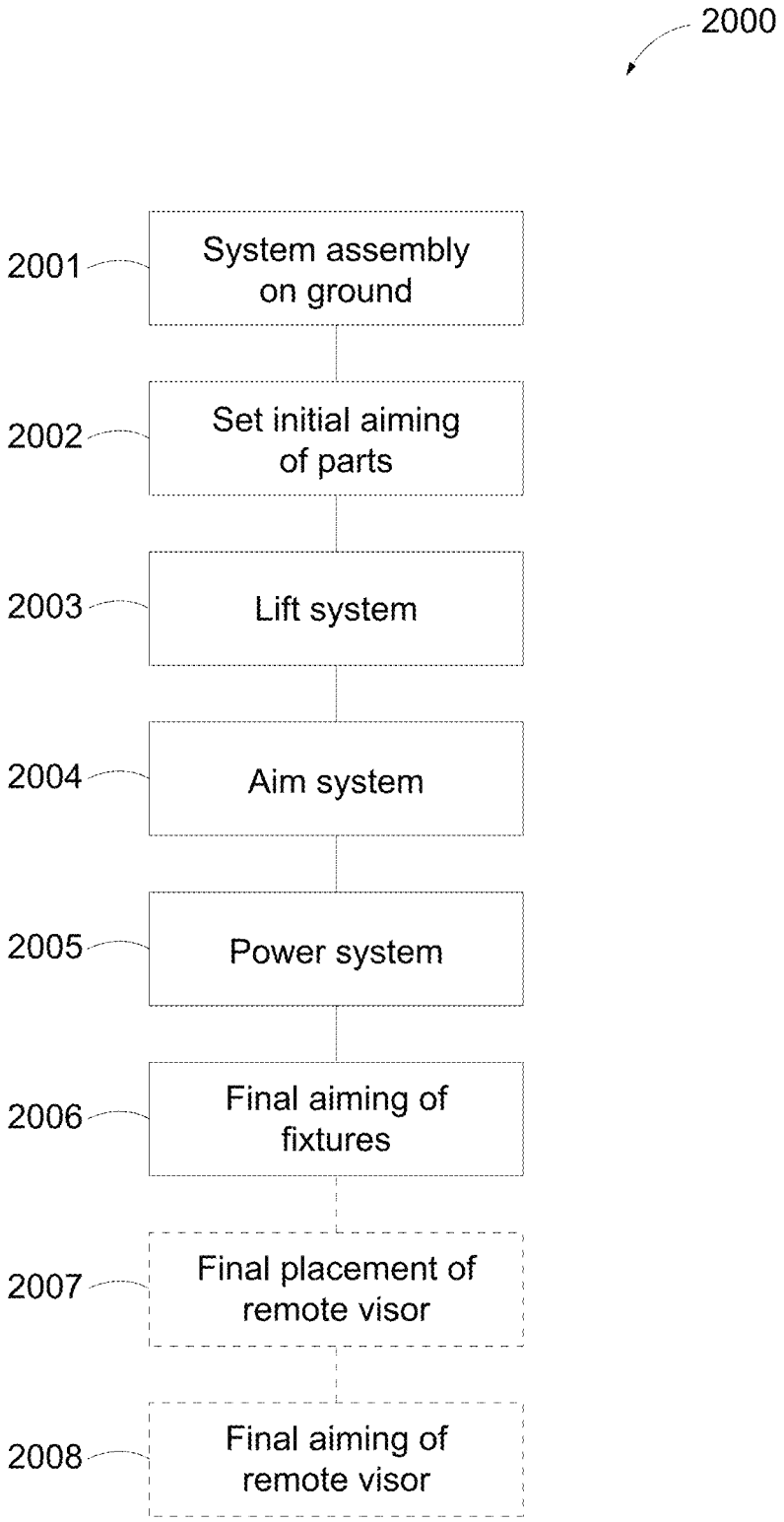
FIG. 36 illustrates one possible method of assembling and installing any of Embodiments 1-5 according to aspects of the present invention at a site.

As envisioned, system 100 includes one or more LED lighting fixtures 600A with associated adjustable knuckles 700. Fixtures 600A may be of a design to include one or more means for both light direction (see FIG. 26) and light redirection such as is described and illustrated in incorporated by reference U.S. Pat. No. 10,378,732. Each fixture may be the same, or may be different in design, LED count, etc. Local visoring (which provides a first stage of beam cutoff) can be at a set angle (as is illustrated in FIGS. 1-11), or could be pivoted in a vertical plane so to provide a variety of angles (as is illustrated in FIGS. 14-23 of incorporated by reference U.S. Pat. No. 10,378,732) e.g., using the same or similar means described later for remote visor assembly 200. For example, as is later discussed for LED lighting fixture 600D (see FIG. 30), LED lighting fixture 600A may include a distal, adjustable, blackened local visor 617 at emitting face 601 which can be moved upward out of the beam projected by the fixture or downward into the beam projected by the fixture to provide additional beam cutoff, absorb any stray light, or minimize striations which might occur from having multiple rows of LEDs. This can be done uniformly across apertures 618/fastening devices 619 to absorb light across a line perpendicular to an aiming axis of the lighting fixture, or non-uniformly across an angled line by lowering one side of visor 617 more than the opposite side (e.g., to accommodate angled target areas such as curves or banks at a racetrack).

Figure 10:
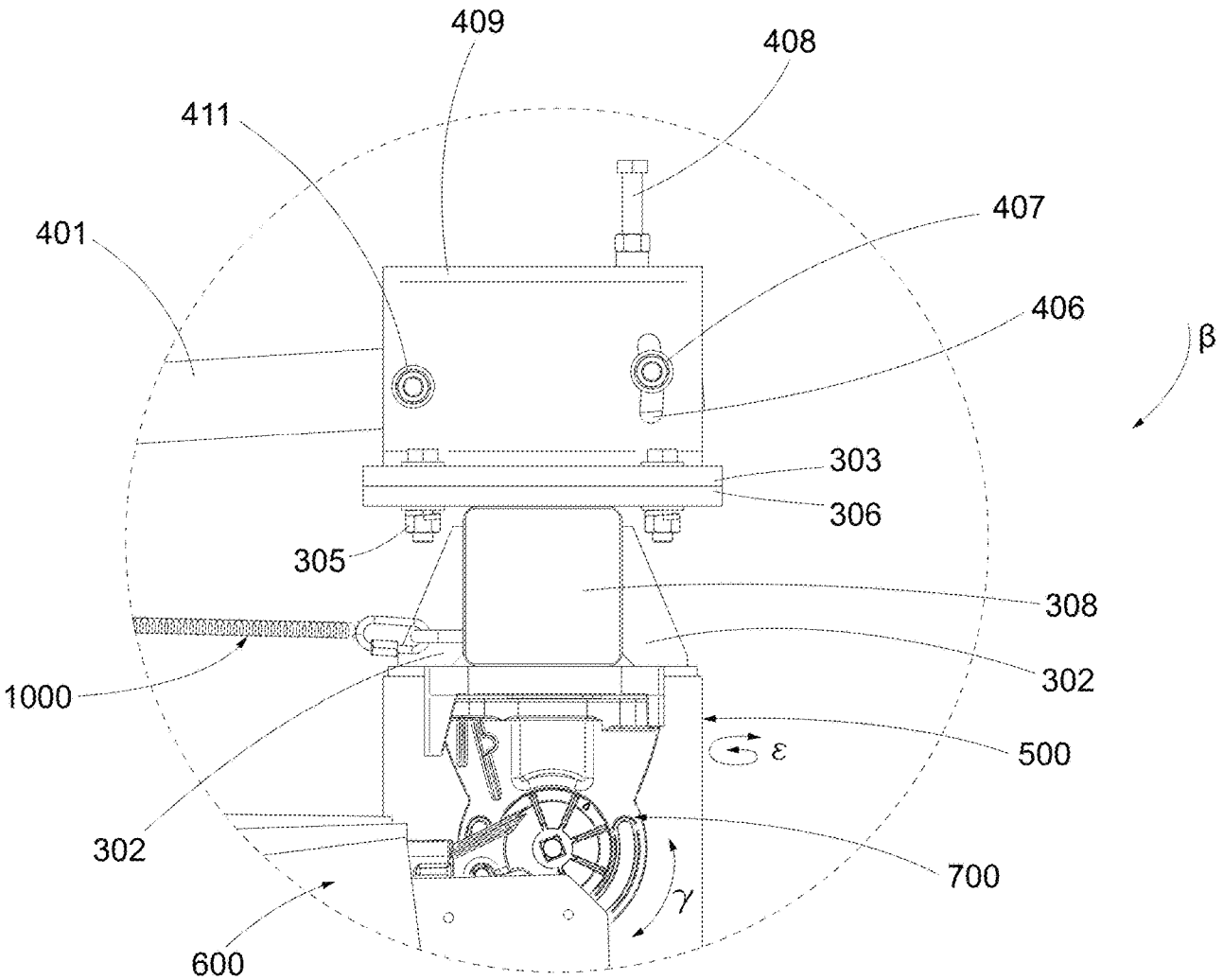
FIG. 10 illustrates an enlarged view of Detail B of FIG. 8.
Figure 11:
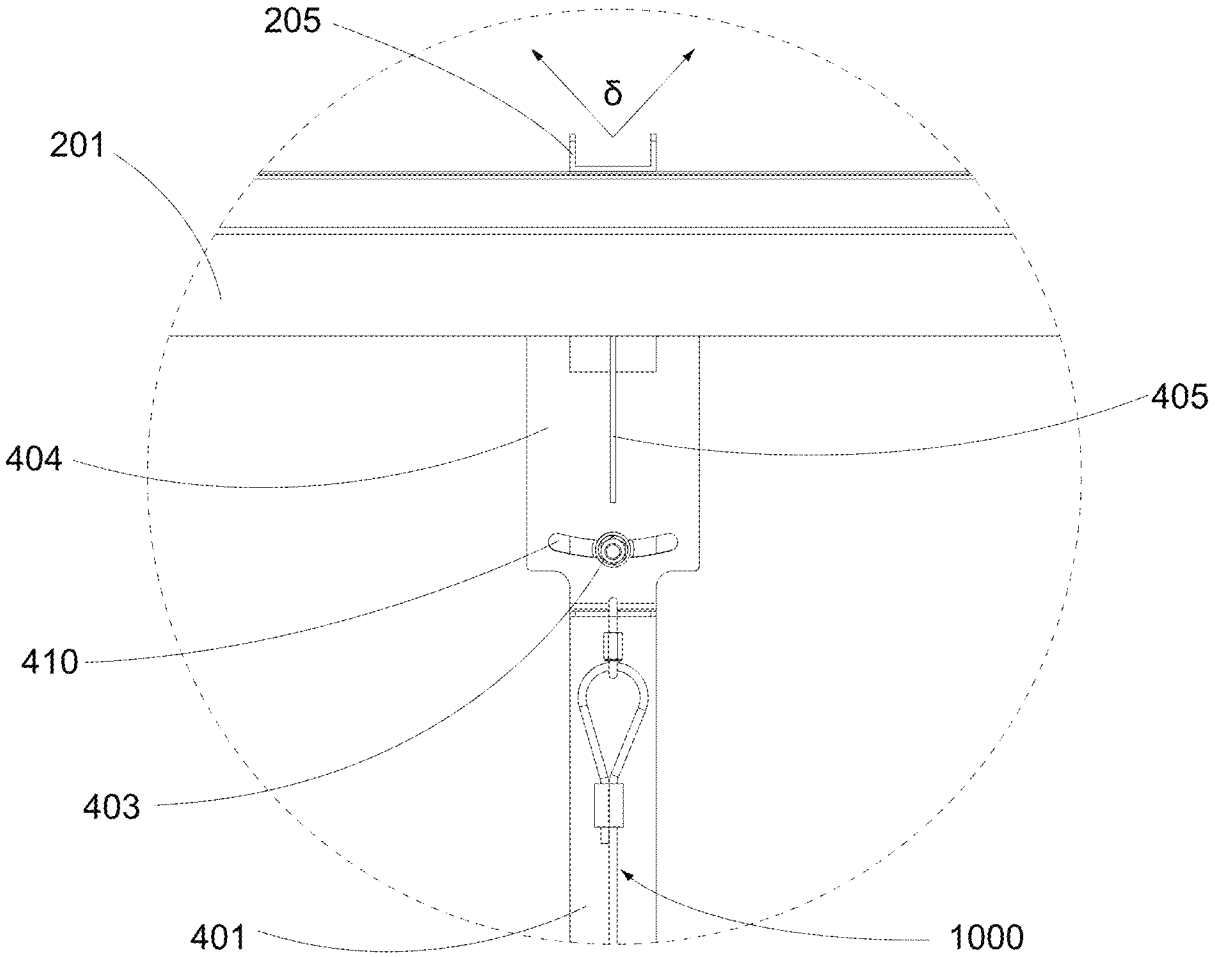
FIG. 11 illustrates an enlarged view of Detail C of FIG. 6.

As envisioned, LED lighting fixtures 600A are adjustably affixed in at least two planes to crossarm assembly 300 (later discussed) via adjustable knuckle assembly 700; FIG. 10 illustrates the pan (angle $\varepsilon$) and tilt (angle $\gamma$) functionality of knuckle 700 such that they provide two axes of adjustable light direction for fixtures 600A. As envisioned, each fixture 600A is associated with a single adjustable knuckle assembly 700 which permits a wide range of both horizontal aiming (i.e., angle $\varepsilon$ providing left and right panning), and vertical aiming (i.e., angle $\gamma$ providing up and down tilting); the needed range will depend on the lighting application, but it is not unreasonable for a horizontal and vertical range on the order of 60 degrees. Each knuckle assembly 700 may have the same operational horizontal and vertical orientation, or different—note, for example, different vertical aiming of fixtures 600A best illustrated in FIGS. 7 and 8. As envisioned, knuckle assemblies 700 are of a design such as that discussed in U.S. Publication No. 2011/0149582 incorporated by reference herein in its entirety, though this is by way of example and not by way of limitation. In practice, for a difficult to light or non-standard target area such as a racetrack, it is desirable for knuckles 700 to be adjusted horizontally such that light is projected no further than 5 degrees upstream of a driver (e.g., to avoid causing glare for a driver) and no further than 15 degrees downstream of a driver (e.g., to avoid physically striking another fixture in an array of fixtures), and aimed vertically such that fixtures 600A are between 0 and 20 degrees down from horizontal (e.g., to prevent light sources from being directly viewable by spectators), though this is by way of example and not by way of limitation.

Ultimately, the desired sharpness of cutoff, beam control, and characteristics of the site and the target area itself will dictate the required lighting uniformity and light level which will in turn dictate the number of lighting fixtures 600A in system 100, which will in turn dictate the spacing of said fixtures 600A within the array of fixtures on crossarm assembly 300, which in turn will dictate both horizontal and vertical aiming of said fixtures 600A via knuckle 700. Of course, the aforementioned has practical limitations—for example, knuckles 700 can only be pivoted so far before fixtures 700 physically interfere with one another, and local visoring can only be pivoted so far before beam shift occurs; as such, more precise lighting is enabled via combination of the aforementioned with a remote visoring assembly 200.

2. Remote Visoring Assembly (200)

Remote visoring assembly 200 provides a second stage, remote light redirection in operative connection with, but physically separated from, local visoring (which provides a first stage, local light redirection) and local light directing means. Remote visoring assembly 200 generally comprises one or more lengths of distal visor 201 which are affixed via fastening devices 202 to an angled arm 205; if said lengths are limited by current manufacturing techniques (e.g., via sheet metal forming, to around 12 feet) they may be joined with a joining section 203 and capped at both ends (e.g., to prevent moisture ingress) with end caps 204, which along with distal visor 201 are rounded so to reduce effective projected area (EPA)—see FIG. 9. In practice, distal visors 201 are formed from a lightweight aluminum alloy and are painted or otherwise coated a flat black on the surface facing lighting fixtures 600A (the "optical face" indicated by arrow A of FIG. 9) so to provide sharp cutoff without redirecting light downward or back towards fixtures 600A such that glare is produced; in this sense light redirecting means 201 are light absorbing or light blocking means, though still considered to be light redirecting means (as previously discussed). Distal visors 201 are affixed to an adjustable support assembly 400 at a fixed angle $\alpha$ which, again, will depend on a number of factors, but for the example of a racetrack (e.g., low mounting heights, large setback) would in at least some mounting positions be set at approximately 115 degrees. In practice angle $\alpha$ is merely the result of other designed variables; for example, if it is desirable for distal visor 201 to have its optical face at an angle relative to lighting fixtures 600A or relative to a defined axis (e.g., 20 degrees from a vertical plane), and the aiming angle of lighting fixtures 600A is known (e.g., a vertical aiming angle approximately 4 degrees down from horizontal), and the length of arm 401 is known (e.g., approximately 6 feet in length), a fixed angle $\alpha$ is the result (again, approximately 115 degrees given the aforementioned).

3. Adjustable Support Assembly (400)

Though a vertical aiming angle of part 201 is set at $\alpha$, remote visoring on the whole can be uniformly adjusted across an array of lighting fixtures 600A in system 100 in both horizontal and vertical planes via adjustable support assembly 400. Horizontal aiming on the order of 15 degrees left or right of vertical (see angle $\delta$, FIG. 11) is achieved via movement of arm 401 about the path defined by aperture 410 which, in turn, pans distal visor 201 via affixed (e.g., welded) plate 404 and strengthening portion 405. When a desired horizontal aiming angle is reached—which could be different for different parts 201 to account for e.g., curvature in a target area—a fastening device 403 is tightened; fastening devices 403 (and fastening devices 402) in general may be loosened and tightened as needed during aiming to positionally affix stabilizing assembly 1000 and plate 404, respectively.

Vertical aiming on the order of 2-8 degrees down from horizontal (see angle $\beta$, FIG. 10) is achieved via pivoting of arm 401 about fastening device 411; the predefined arc length of aperture 406 aids in preventing vertical aiming above horizontal (as indicated by the single-headed arrow at angle $\beta$) so to e.g., prevent a vertical aiming which may cause glare. That being said, there may be some situations where it is actually desirable to pivot distal visor 201 above horizontal and out of the path of the composite beam as projected from fixtures 600A; one example is to facilitate more effective in situ adjustment of local visoring (later discussed), and another example is when the target area is uphill of the mounting location (e.g., a banked racetrack).

When a desired vertical aiming angle is reached—which, again, could be different for different parts 401 (and therefore, different spans of remote visoring)—fastening devices are tightened. Here, the primary function of fastening device 408 is to set the vertical aiming angle, but the jam nut portion of device 408 which abuts housing 409 does aid in securing arm 401 in situ in the vertical plane. In the horizontal plane fastening device 411 and fastening device 407 (which extends through arm 401 and out either side of housing 409 via aperture 406) are both tightened to secure arm 401 in situ. As envisioned, adjustable support assembly 400 is also formed from a lightweight aluminum alloy, and so the combination of devices 407, 408, and 411 are adequate to provide the needed force to secure arm 401. This proximate end of adjustable support assembly 400 (proximate insomuch that it is proximate the lighting fixtures) is affixed to another portion of the common infrastructure—namely, crossarm assembly 300—at top plate 303 (which may be integrally formed with housing 409). As can be seen from FIG. 5, top plate 303 contains apertures 304 which permits each arm 401—and by extension, remote visoring assembly 200—to pan left and right on the order of said angle $\delta$ (here, 15 degrees).

So it can be seen that there are apparatus, method, and system for (i) uniform adjustment of remote visoring assembly 200 across an array of lighting fixtures at both proximate (i.e., closer to the fixtures) and distal (i.e., further away from the fixtures) ends, (ii) individual adjustment of portions of remote visoring assembly 200 at both proximate and distal ends, and (iii) individual adjustment of the local visoring (i.e., at fixture 600A).

4. Crossarm Assembly (300)

As stated, arm(s) 401 may pan left and right some degree as is defined by the size and shape of apertures 304 in top plate 303. Once a desired horizontal aiming angle is reached, fastening devices 305 which extend through apertures 304 and into bottom plate 306 (see FIG. 6) may be tightened. Bottom plate 306 may be integrally formed with or otherwise affixed to arm 301, which may in turn, be capped at both ends (e.g., to prevent moisture ingress) with end caps 308. Crossarm assembly 300 further comprises a strengthening portion 302 formed from structural steel (unlike assemblies 200 and 400 which are primarily formed from aluminum alloy) which supports all of aforementioned relative to support structure assembly 500 (which is also formed from structural steel, later discussed).

5. Stabilizing Assembly (1000)

While the aforementioned assemblies when taken together provide for precise LED lighting with increased sharpness of cutoff and/or beam control, the construction of such is also designed to reduce both cost and weight; for example, it is both cheaper and lighter to use adjustable support assembly 400 to position remote visoring assembly 200 than to simply extend the visor of each lighting fixture 600A the same distance (ignoring, of course, undesirable beam shift which would result in such a case). A consequence, however, is that in the case of pole mounting (i.e., via support structure assembly 500, discussed below), some degree of rigidity is desirable so that system 100 on the whole may withstand wind without oscillating or otherwise moving to the point that the lighting is perceivably impacted. To that end, three possible designs of stabilizing assembly 1000 (i.e., 1000A, 1000B, and 1000C) are envisioned to accommodate a range of desired rigidity; these are illustrated in FIGS. 12A-14B and are presently discussed (note that for simplicity, the rest of system 100 are only generically rendered and some portions (e.g., LED lighting fixtures 600) are omitted).

Figure 12A:
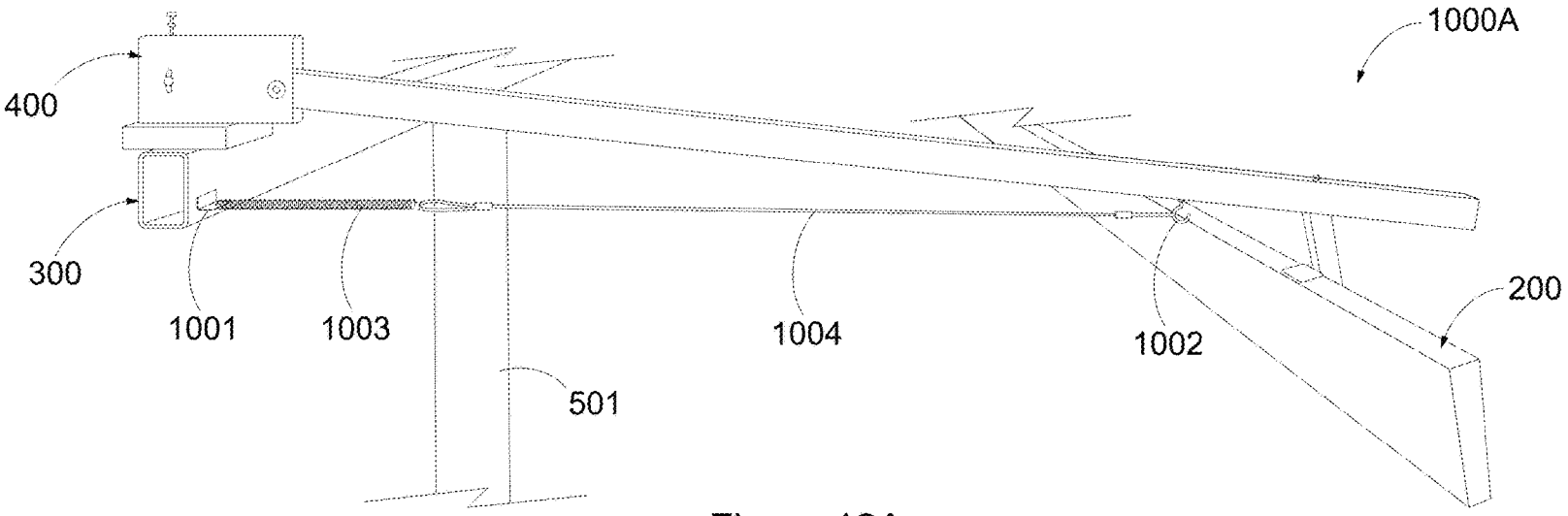
FIGS. 12A and B illustrate a first embodiment of a stabilizing assembly according to aspects of the present invention; here, a spring-and-hook combination means. It is of note that the rest of system 100 is only generically illustrated (e.g., assembly 400 is simplified, assembly 300 is missing end cap 308, fixtures 600 are omitted), and only partially illustrated (as indicated by single break lines).
Figure 12B:
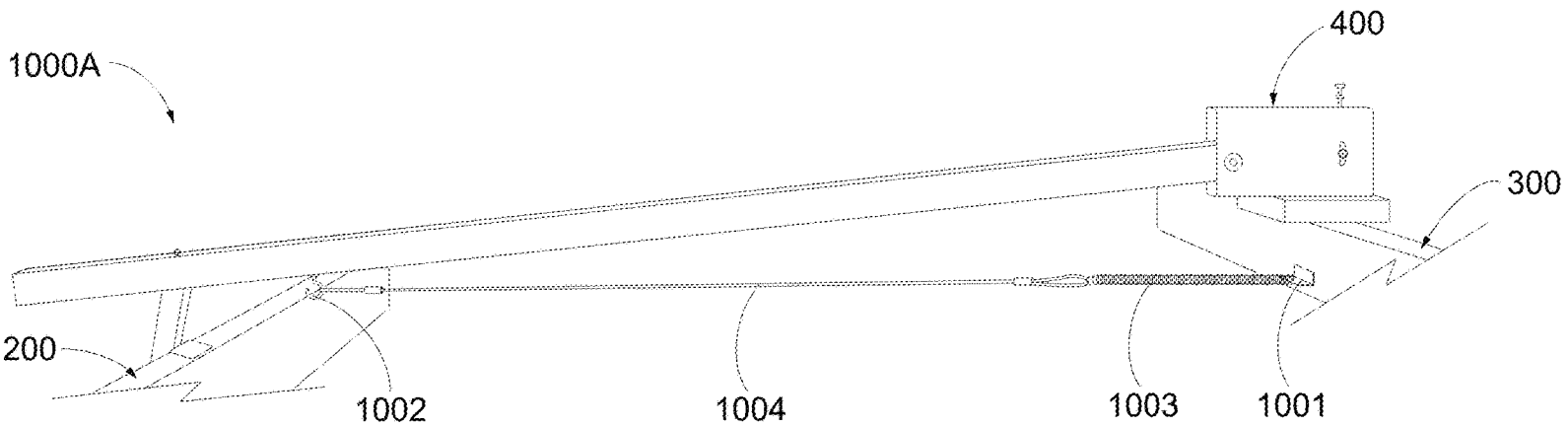

FIGS. 12A and B illustrate a first design of stabilizing assembly 1000A which includes rigid means 1004 (here, a 3/16" wire rope commonly available from a number of vendors) which is affixed to adjustable support assembly 400 via fastening means 1002 (here, a hook) in combination with resilient means 1003 (here, a 9 lb/in overload prevention spring (i.e., a drawbar spring) commonly available from a number of vendors) which is affixed to crossarm assembly 300 via fastening means 1001 (here, a weldment). Stabilizing assembly 1000A represents the most flexible/resilient and least rigid of the designs envisioned.

Figure 13A:
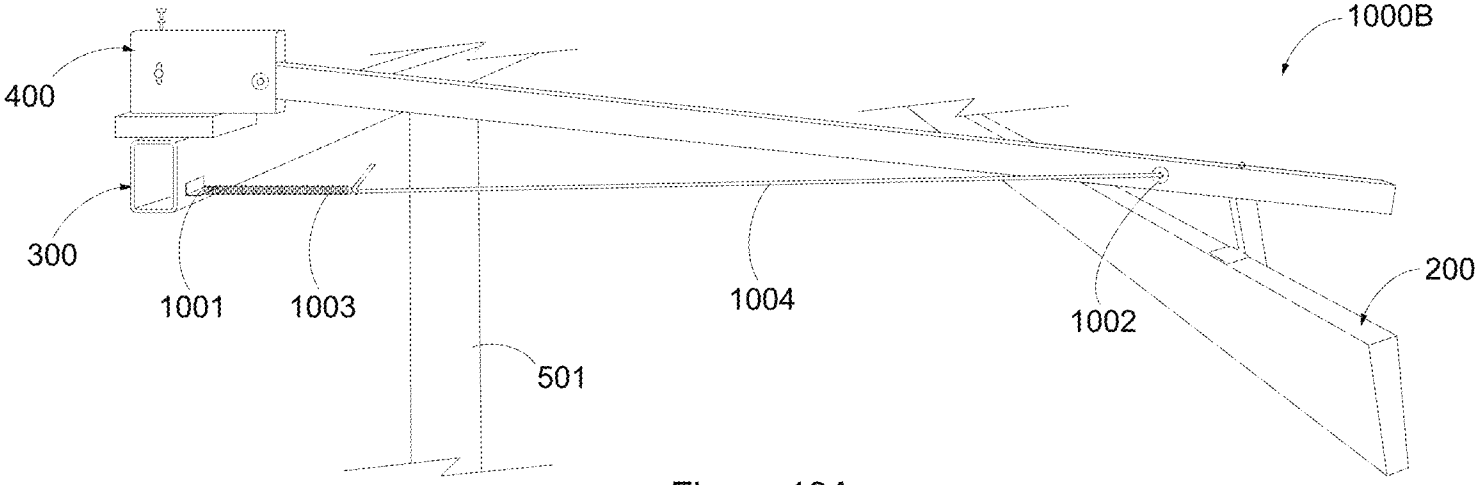
FIGS. 13A and B illustrate a second embodiment of a stabilizing assembly according to aspects of the present invention; here, a spring-and-rod combination means. It is of note that the rest of system 100 is only generically illustrated (e.g., assembly 400 is simplified, assembly 300 is missing end cap 308, fixtures 600 are omitted), and only partially illustrated (as indicated by single break lines).
Figure 13B:
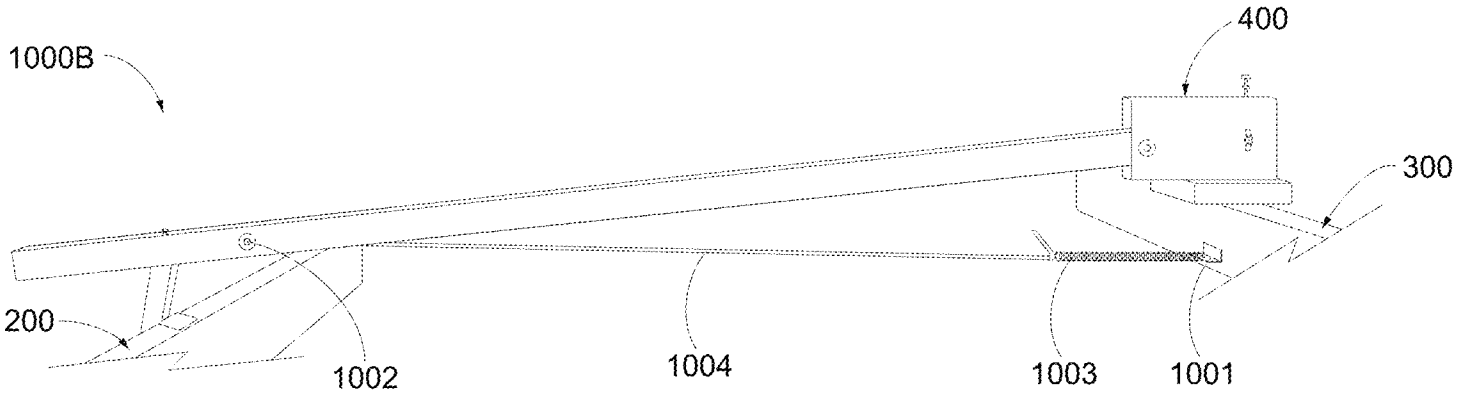

Stabilizing assembly 1000B of FIGS. 13A and B represent an increase in rigidity insomuch that the overall length of resilient means 1003 (again, a drawbar spring) is reduced relative to the length of rigid means 1004 (here, a rod), and fastening means 1002 of stabilizing assembly 1000B prevents movement more than fastening means 1002 of stabilizing assembly 1000A. Specifically, the end of rod 1004 which is pulled through assembly 400 at an aperture in arm 401, threaded, and affixed with a washer/nut having a size larger than that of the aperture in arm 401 of assembly 400 (i.e., fastening means 1002 of assembly 1000B) prevents vertical and/or horizontal movement of remote parts of system 100 more than a hook (i.e., fastening means 1002 of assembly 1000A).

Figure 14A:
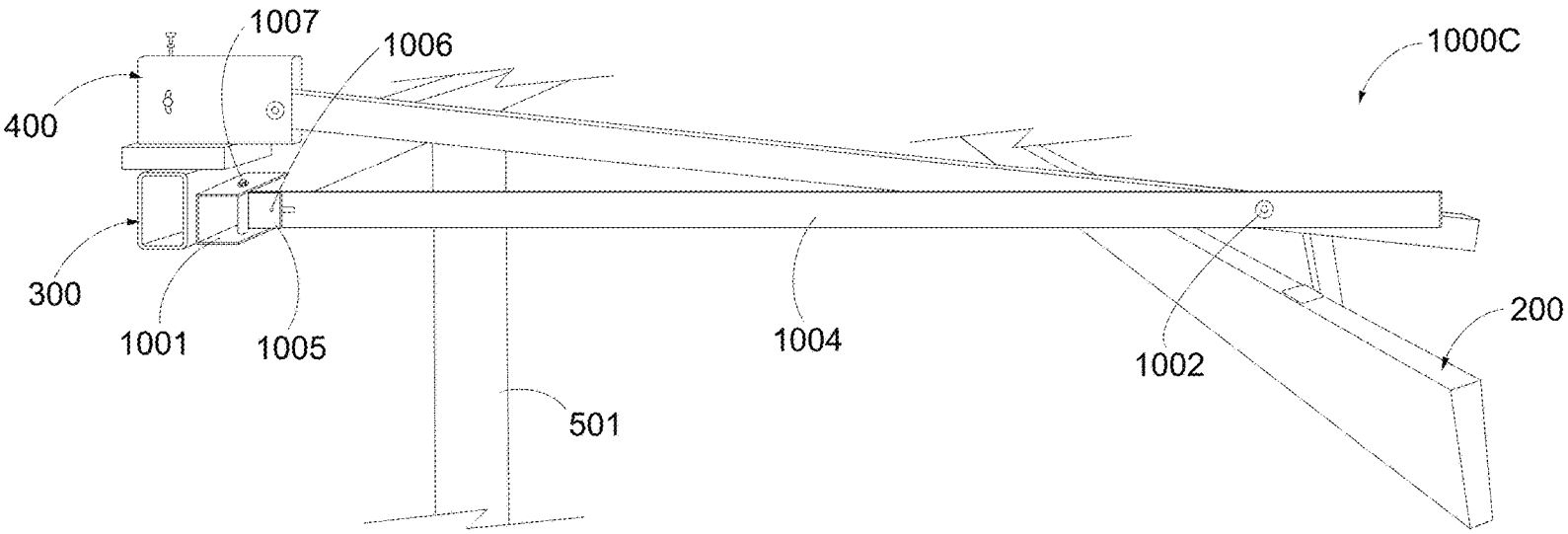
FIGS. 14A and B illustrate a third embodiment of a stabilizing assembly according to aspects of the present invention; here, an adjustable rigid bar means. It is of note that the rest of system 100 is only generically illustrated (e.g., assembly 400 is simplified, assembly 300 is missing end cap 308, fixtures 600 are omitted), and only partially illustrated (as indicated by single break lines).
Figure 14B:
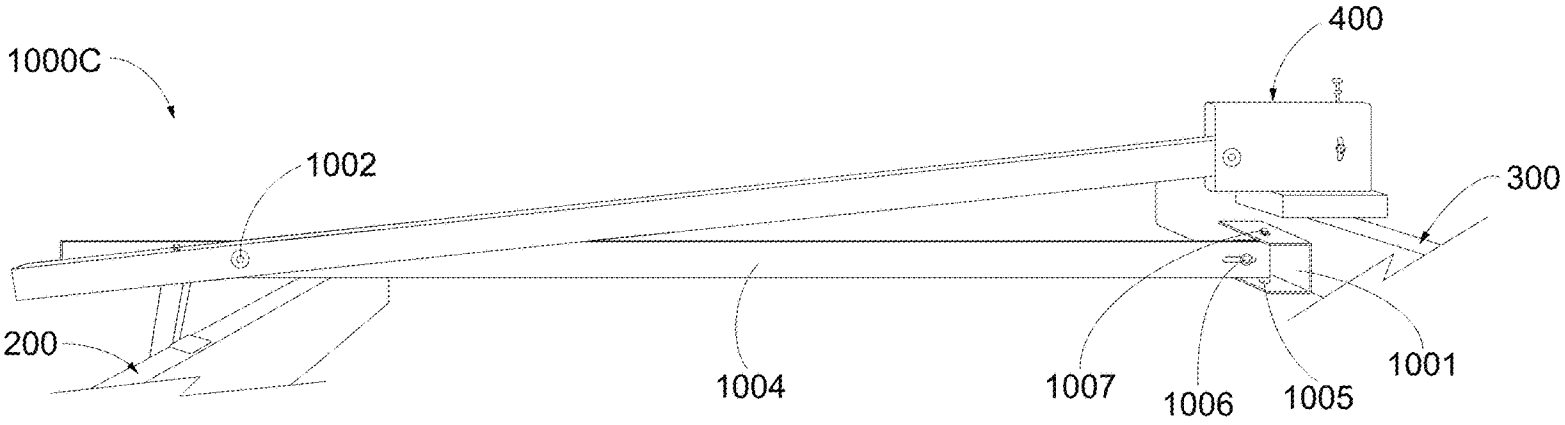
Figure 15:
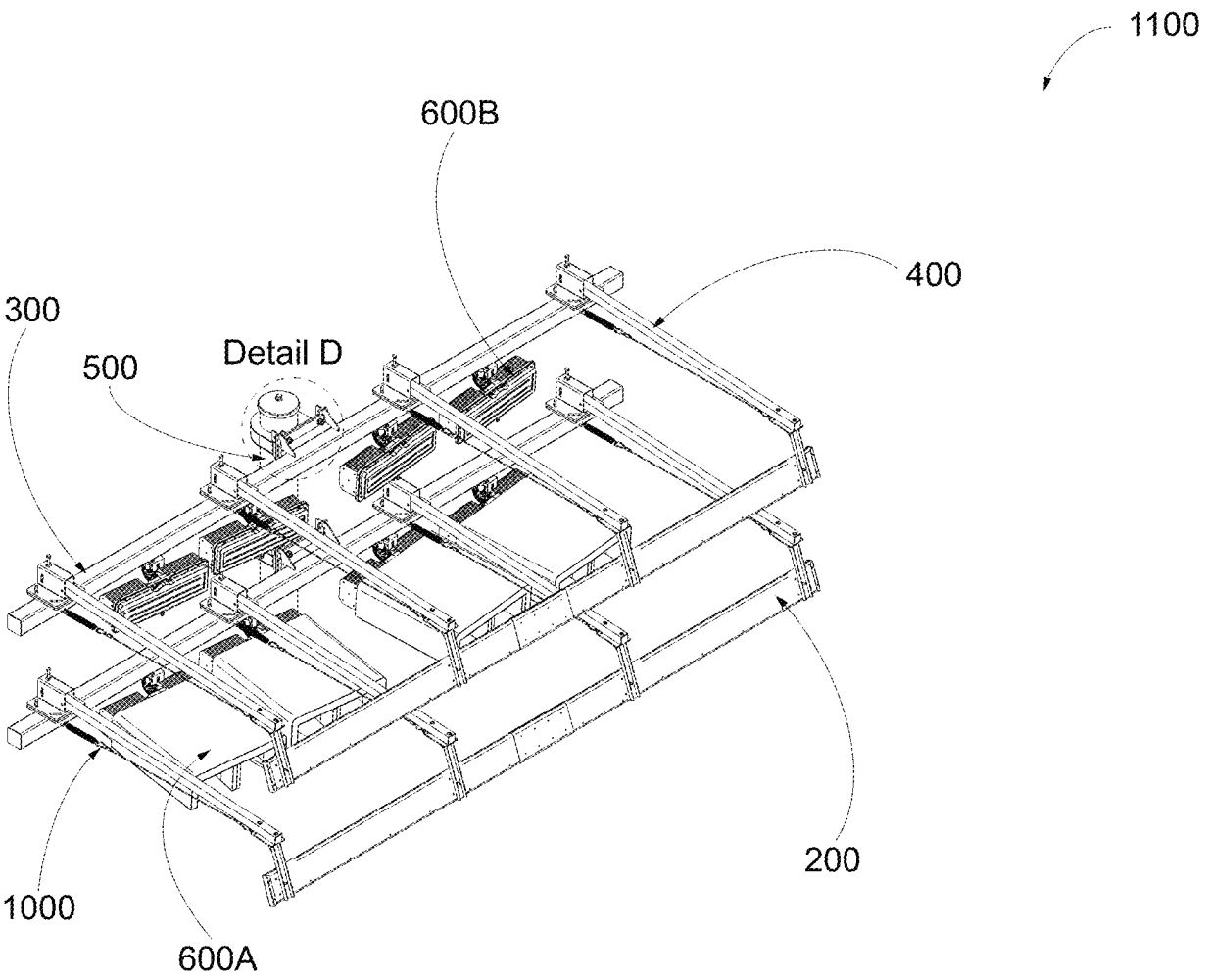
FIG. 15 illustrates a top front perspective view of a second embodiment to provide precise LED lighting according to aspects of the present invention; here, using both local and remote visoring in the bottom row of a stacked fixture configuration, and remote visoring only in the top row of the stacked fixture configuration. Note that eight lighting fixtures with associated knuckles are illustrated, though this is by way of example and not by way of limitation in terms of both quantity and design.
Figure 16:
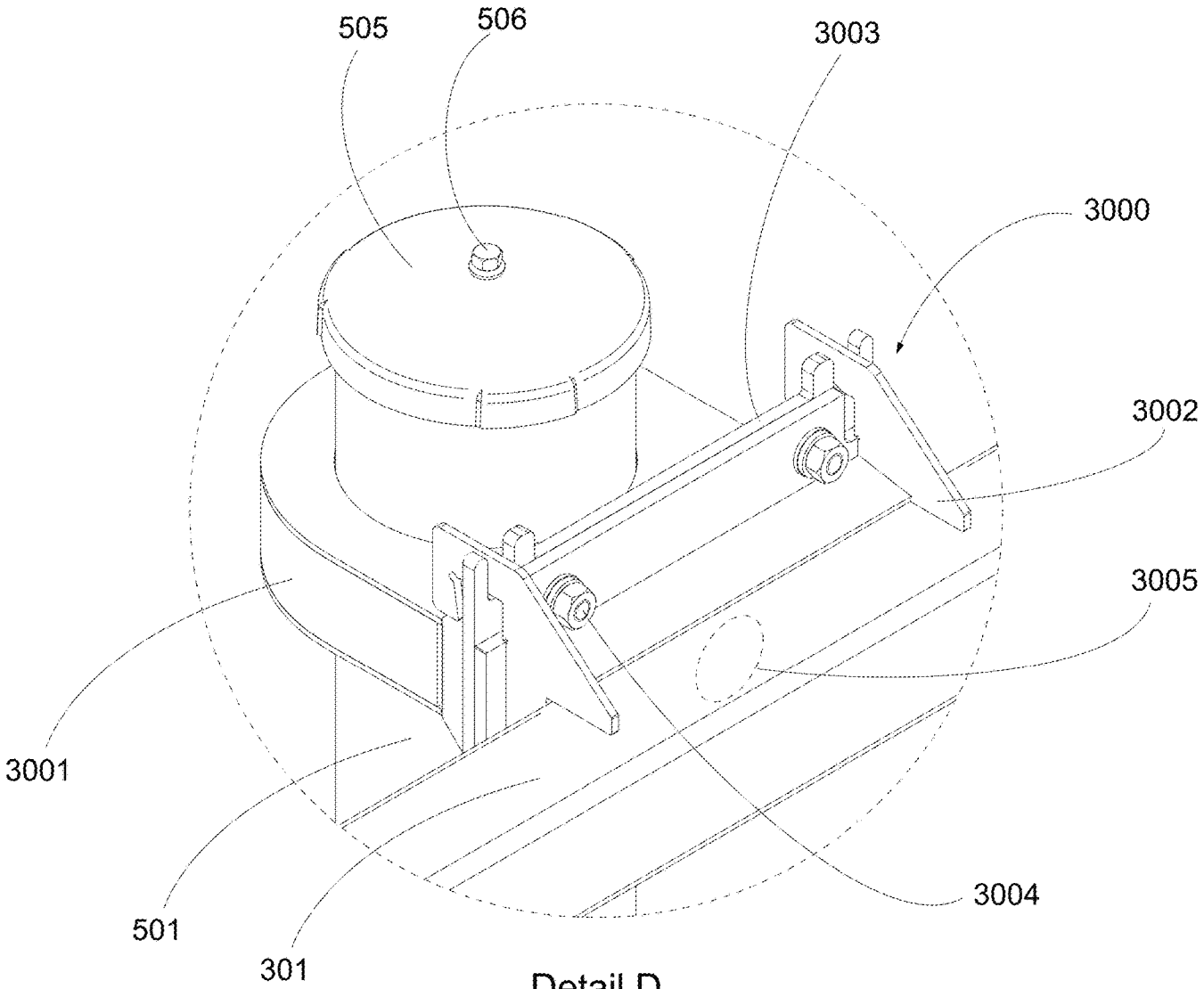
FIG. 16 illustrates an enlarged view of Detail D of FIG. 15.

The most rigid option is illustrated in FIGS. 14A and B for stabilizing assembly 1000C. Here, there are no resilient means, and rigid means 1004—which span the length of the assembly—comprise a strip or bar (or other material more rigid than a wire), thereby only allowing for horizontal deflection. Fastening means 1002 at the distal end (i.e., the end furthest from lighting fixtures 600, not illustrated) may comprise a nut and bolt combination which extends through an aperture in both parts 401 and 1004, and fastening means at the proximate end (i.e., the end nearest the lighting fixtures) may comprise a combination of welded bracket 1001 adapted to receive an adjustable portion 1005 which pivots about fastening device 1007 and is affixed to rigid means 1004 via fastening means 1006 extending through an aperture in rigid means 1004.

6. Support Structure Assembly (500)

All of the aforementioned are formed and affixed to support structure assembly 500 which generally comprises a hollow pole 501 which is affixed to or integrally formed with a mounting plate 502 with a plurality of apertures 503 to (i) facilitate pivoting about a vertical axis (i.e., about an axis through the center of the pole) and (ii) provide an interface to mate to an existing pole base (e.g., in the case of retrofit). As envisioned, pole 501 is formed from a structural steel (or is otherwise more robust than other parts of system 100 formed from aluminum alloy), and at least partially hollow (see aperture 504, FIG. 6) so to allow for the internal routing of wiring from lighting fixtures 600A to a power source (e.g., remote generator, drivers in an enclosure mounted to pole 501).

C. Exemplary Apparatus Embodiment 2

A second embodiment in accordance with at least one aspect of the present invention envisions a stacked configuration of lighting fixtures 600 (here, a specific configuration 600B on the top row and configuration 600A from Embodiment 1 on the bottom row) for (i) increased density of light from a single pole location, or (ii) a compact spacing of lighting fixtures (e.g., where adjacent poles prevent several fixtures in a single array). As can be seen from FIGS. 15 and 16, system 1100 according to the present embodiment is similar to that of Embodiment 1 but with different (i) layout of lighting fixtures 600A/B, knuckles 700, and crossarm assembly 300, (ii) design of support structure assembly 500, and (iii) inclusion of a fitter assembly 3000.

Here, LED lighting fixtures 600A are of the design described in Embodiment 1 and incorporated U.S. Pat. No. 10,378,732; namely, having a first stage of beam cutoff (specifically, vertical beam cutoff) via angling of local visoring (specifically, up-and-down/tilting angling)—which could be preset or adjustable in situ. According to the present embodiment, LED lighting fixtures 600B are similar to LED lighting fixtures 600A but omit local visoring; light directing means (e.g., as provided by a silicone sheet of secondary lenses 802 as held proximate and in operative connection with LED light sources 801 via an optics holder 803, FIG. 26) is the same for LED lighting fixtures 600A and 600B. Further, as compared to Embodiment 1, crossarm assembly 300 has been moved to the front of support structure assembly 500 instead of on top of support structure assembly 500, and a pole cap 505 with retaining wire/nut combination 506 has been included so to allow access to the generally hollow interior of pole 501 (e.g., for pulling and connecting wiring). Fitter assembly 3000 generally comprises pole portion 3001 (which is likely welded to a pole section 501 at the factory), back plate 3003 (which is likely welded to pole portion 3001 at the factory), front plate 3002 (which is likely welded to an arm section 301 at the factory), aperture 3005 (e.g., to aid in internally routing wiring from fixtures 600 into pole 501), and fastening devices 3004. In practice, parts 3002 (and therefore part 301) and 3003 (and therefore part 501) would be brought into abutment and bolted together via fastening devices 3004 at step 2001 of method 2000 (later discussed).

Embodiment 2 may be preferable in situations where a bolt-on style crossarm is desirable to make wire pulling and joining of electrical connectors easier (e.g., due to access at part 505/506), fixtures 600A/B need to be stacked because there is not enough physical space to place all fixtures in a single array (e.g., existing pole locations are too close together), or it is desirable to ship assemblies in physically smaller parts (e.g., twelve fixtures could be broken up into two arrays of six fixtures).

D. Exemplary Apparatus Embodiment 3

A third embodiment in accordance with at least one aspect of the present invention envisions Embodiment 1 modified to accommodate a difficult to light or non-standard target area that requires some degree of uplight—for example, some baseball lighting applications. As can be seen from FIG. 17, system 1200 according to the present embodiment is similar to that of Embodiment 1 but with different (i)

fixtures 600 (here the specific configuration 600B from Embodiment 2), and (ii) support structure assembly 500.

As in the top row of stacked fixtures in Embodiment 2, local visoring is omitted from LED lighting fixtures 600B so to permit some degree of uplight. Further, support structure assembly 500 includes one or more generally hollow pole sections 501 slip-fit onto a base or otherwise set directly in the ground—as can be seen from the ground mounting in FIG. 17—as opposed to bolted onto a pole base as in Embodiment 1. In practice, optional step 2007 of method 2000 (later discussed) may not be required since there may be no motivation to pivot away remote visors (since there are no local visors to preliminarily aim).

Figure 37A:
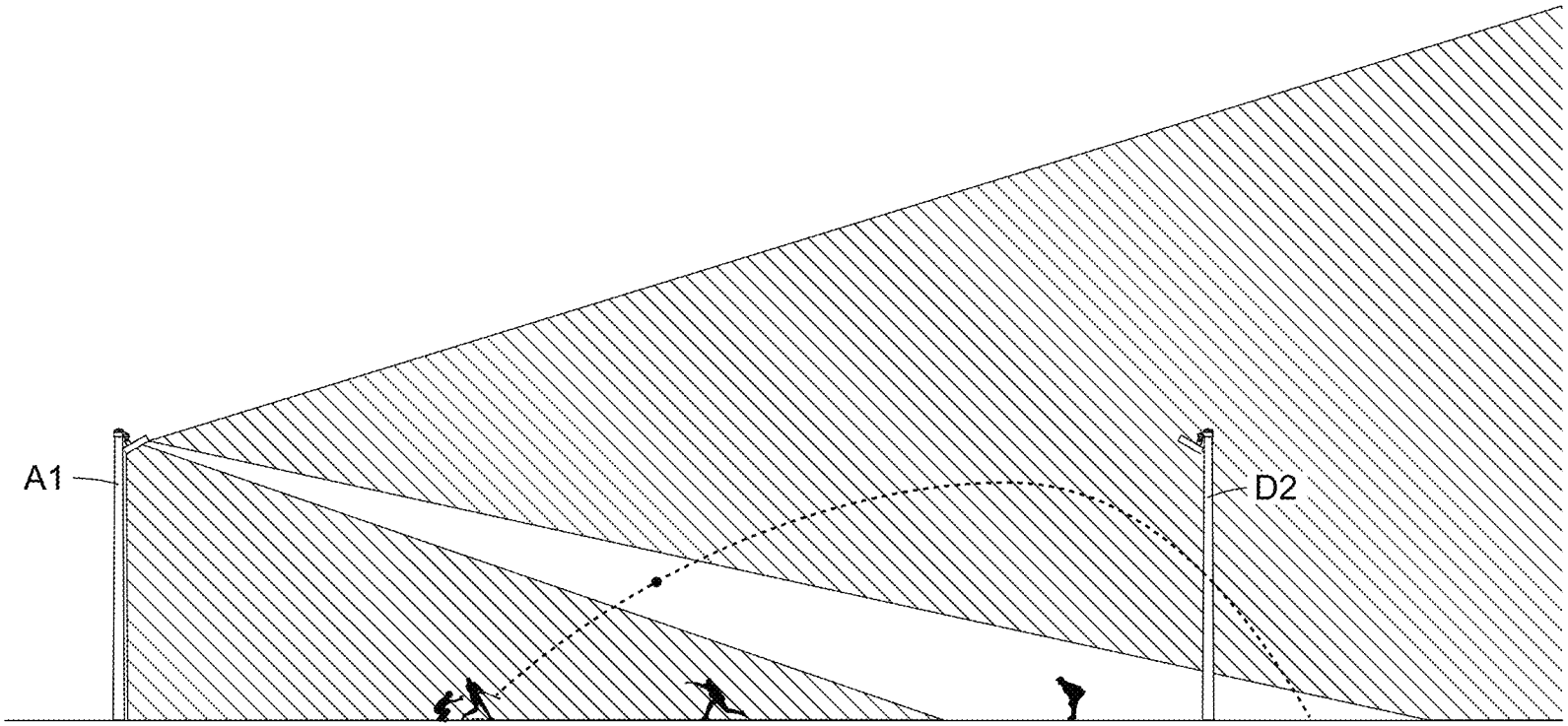
FIGS. 37A-C illustrate diagrammatically three views of a lighting application which might benefit from aspects according to the present invention; here, a baseball field with hatching indicating areas of useful light.
Figure 37B:
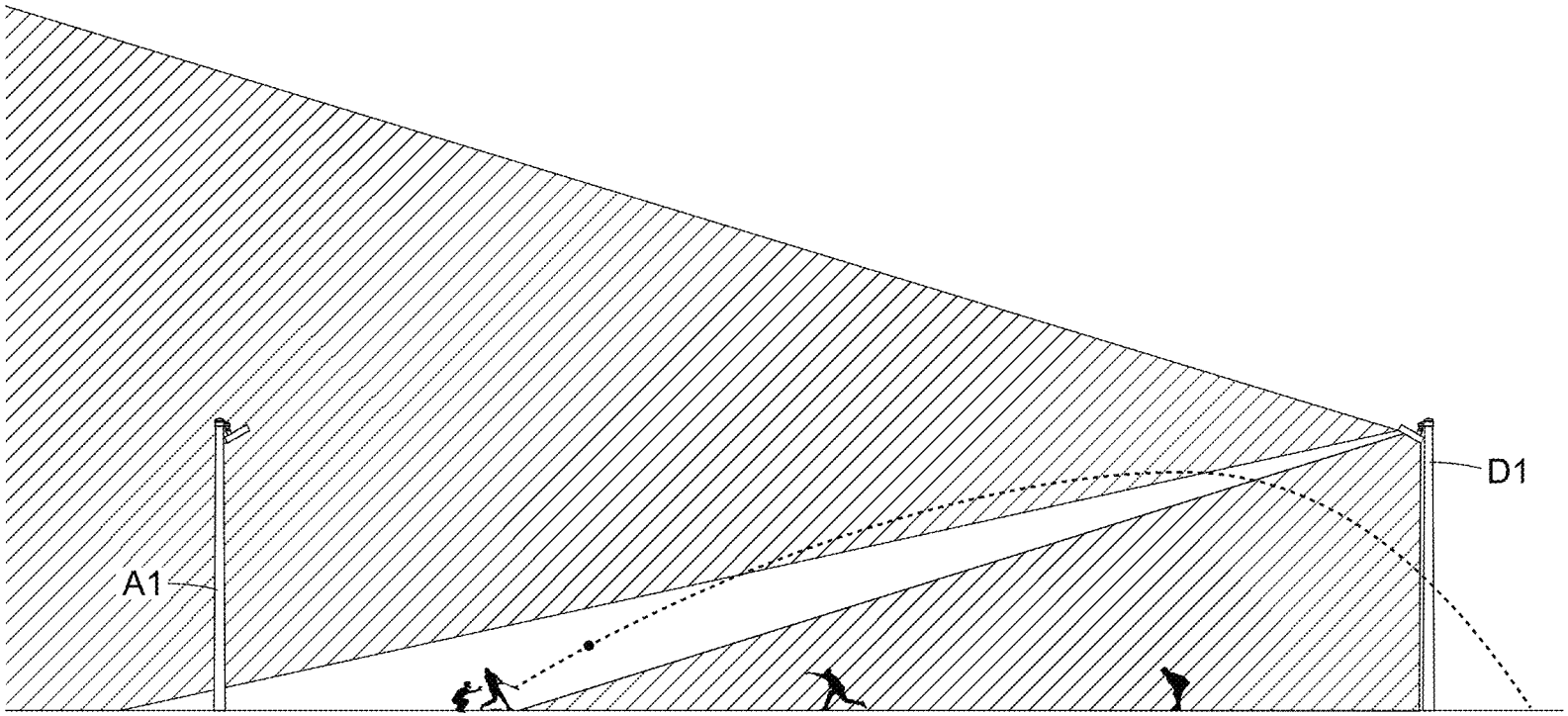
Figure 37C:
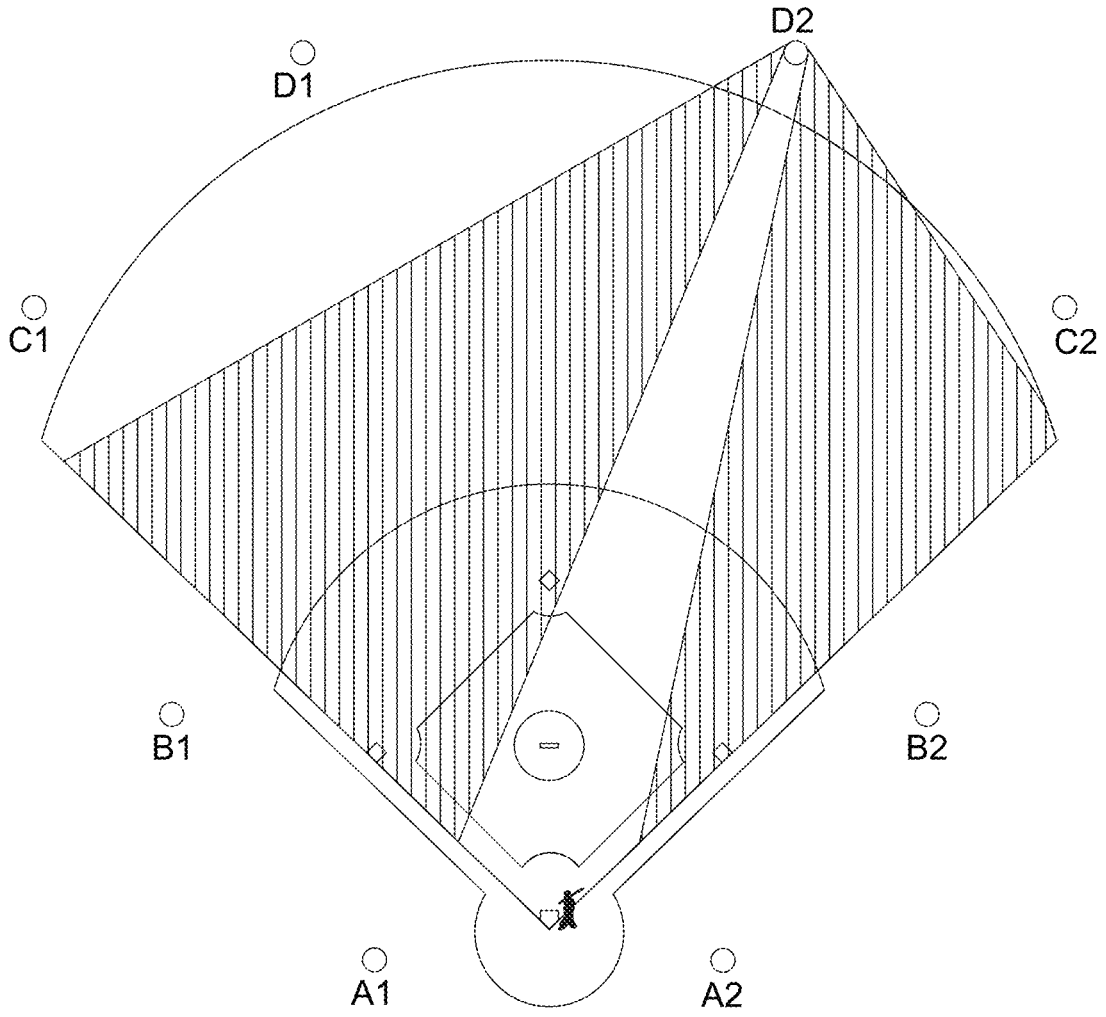

Embodiment 3 may be preferable in situations where there is no pre-existing bolt-on pole base, or where sharp cutoff and beam control is desired but so too is uplight; see, for example, FIGS. 37A-C. As can be seen from the diagrammatic depiction of light (here, shown as hatched regions) the target area includes not only a surface of play but also the aerial region above the surface of play; further, there are clearly defined areas where light is not wanted (here, shown as non-hatched regions). To address both needs requires both uplight and precise lighting—as is provided by this Embodiment 3. See, for example, U.S. Pat. No. 10,337,680 incorporated by reference herein in its entirety for further discussion regarding how these needs may differ depending on pole location (e.g., A1, D2) and player position (e.g., pitcher, batter).

E. Exemplary Apparatus Embodiment 4

A fourth embodiment in accordance with at least one aspect of the present invention envisions Embodiment 1 modified to accommodate a difficult to light or non-standard target area that requires additional adjustability at the local visoring level to (i) provide even sharper beam cutoff in the vertical plane at precise locations, and (ii) provide even greater beam control in the horizontal plane. As can be seen from FIGS. 18-25, system 1300 according to the present embodiment is similar to that of Embodiment 1 but with (i) different fixtures 600 (here, a specific configuration 600C), and (ii) no remote visor assembly 200 but including a local visor assembly.

Figure 26:
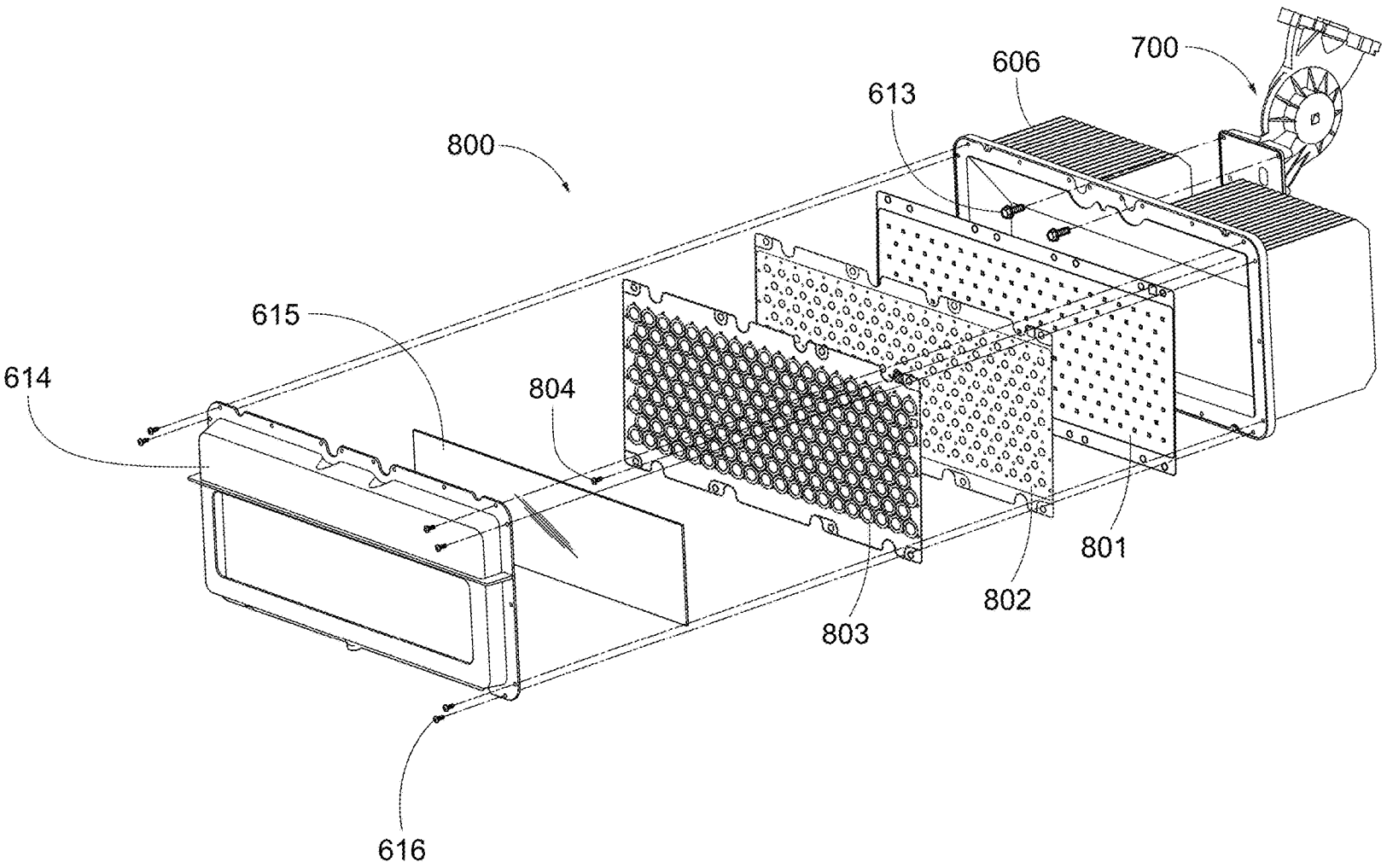
FIG. 26 illustrates an enlarged, isolated, exploded perspective view of LED light source assembly 800 according to aspects of the present invention.

LED lighting fixture 600C includes as its light source a plurality of LEDs 801 (e.g., XM-L2 LEDs available from Cree LED, Durham, N.C., USA) which are mounted to a heat sink 606 of the LED lighting fixture (which is further affixed to knuckle 700 via fastening devices 613); see FIG. 26. Light directing means comprise a silicone or otherwise optical grade sheet 802 having a plurality of secondary lenses formed therein, each integral secondary lens designed to encapsulate and collimate light from one or more LEDs 801 (here illustrated as one lens-to-one LED, though that could differ). An optics holder 803 may be mounted directly to heat sink 606 via fastening devices 804 (note for clarity only one is illustrated) and is designed to hold lenses 802 and LEDs 801 in their correct operational orientation in the internal space of LED lighting fixture 600C. An emitting face 614 with a light transmissive glass 615 seals LED light source assembly 800 in the internal space of the LED lighting fixture via fastening devices 616 which extend through part 614 and into part 606 (note for clarity only six are illustrated). In this sense each lighting fixture 600 produces a symmetric, narrow beam (i.e., with maximum candela more-or-less centered about an aiming axis and then evenly distributed and tapered off across the beam) via use of LED light source assembly 800, with the ability to pan and tilt said symmetric beam (e.g., via knuckle 700) alone, or in combination with light redirection provided by visoring (depending on the embodiment). As discussed and illustrated herein, all of Embodiments 1-5 rely on the aforementioned as the light source, light directing means, and general structure of the lighting fixture housing; however, this is by way of example and not by way of limitation. One option for providing a non-symmetric beam (here, via diffuser sheet) is later discussed, and could also be used with any of Embodiments 1-5.

Figure 27B:
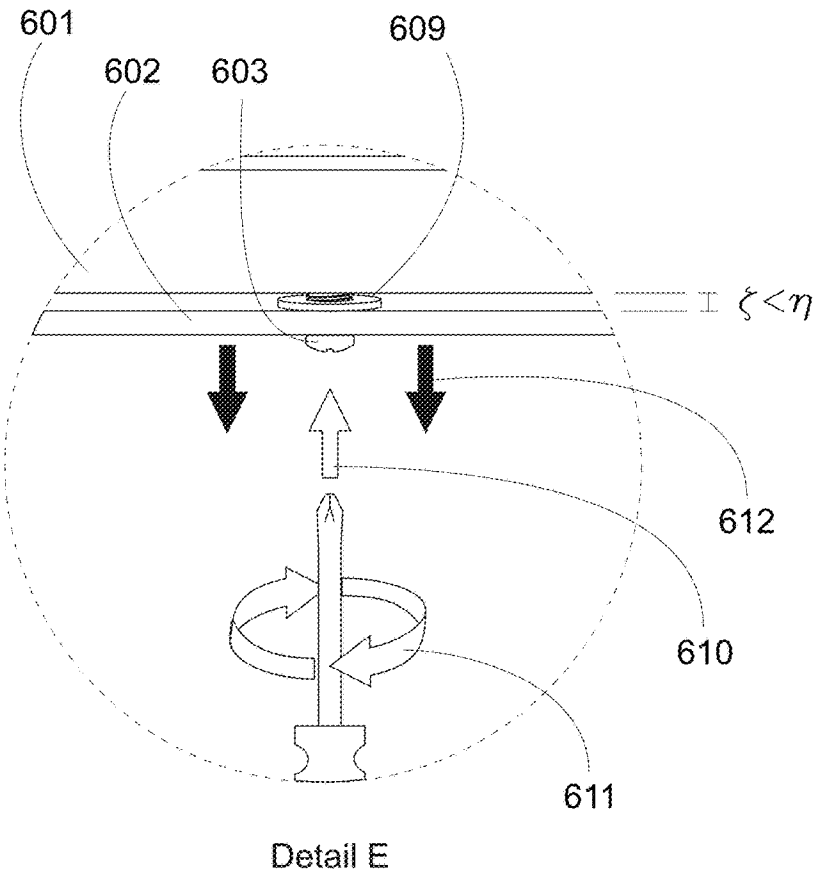
FIGS. 27A and B illustrate an enlarged, isolated, front view of a single LED lighting fixture of Embodiment 4, and illustrates in greater detail the means for adjustment of local visoring used in Embodiments 4 and 5.
Figure 27A:
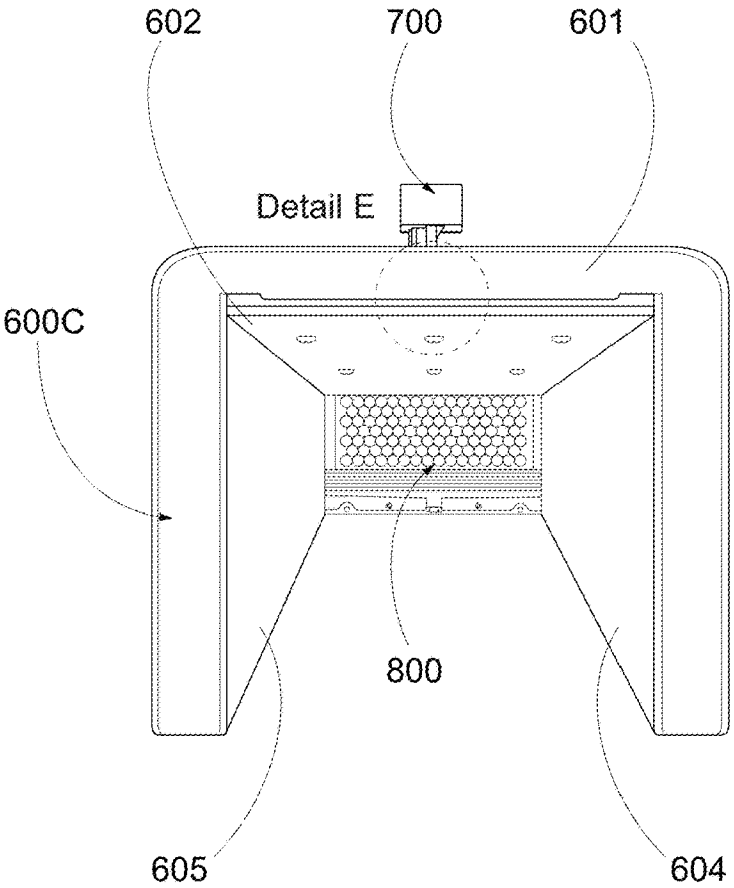
Figure 28:
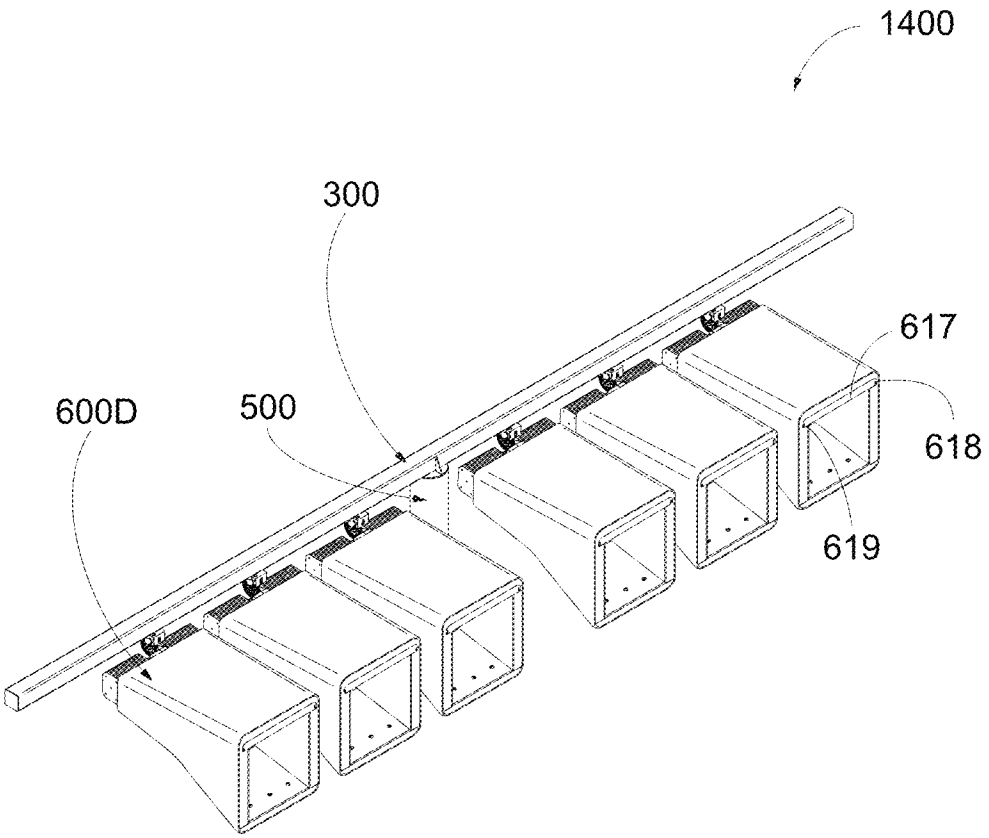
FIG. 28 illustrates a top front perspective view of a fifth embodiment to provide precise LED lighting according to aspects of the present invention; here, using local visoring only. Note that six lighting fixtures with associated knuckles are illustrated, though this is by way of example and not by way of limitation in terms of both quantity and design.
Figure 29:
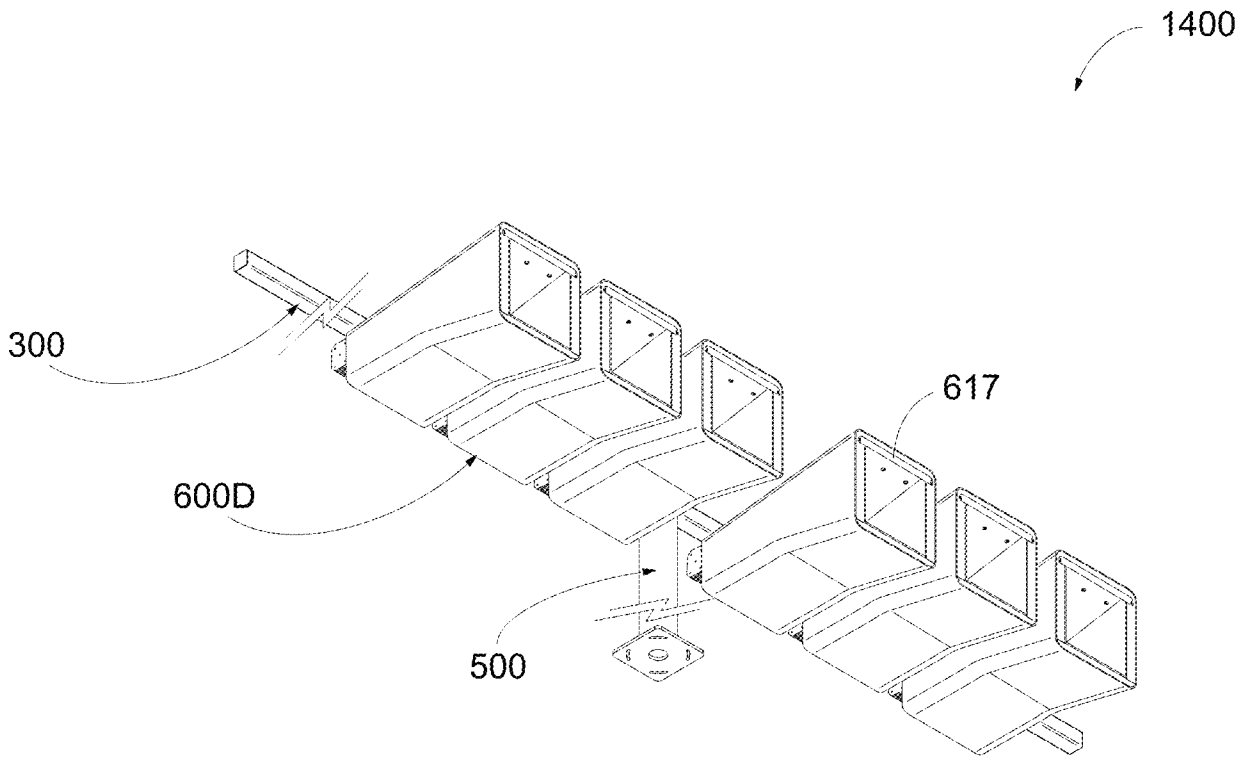
FIG. 29 illustrates a bottom front perspective view of FIG. 28; here, with double break lines indicating variable lengths. It is of note double break lines have been omitted from FIGS. 28, and 30-35 for clarity.

A first stage, local light redirection is provided—as in Embodiment 1—but unlike Embodiment 1, the present embodiment has no second stage, remote light redirection; further, said first stage, local light redirection of the present embodiment occurs on three adjustable surfaces (as opposed to one adjustable surface/plane in Embodiment 1). With respect to providing even sharper beam cutoff in the vertical plane at precise locations, this is provided by selectively tightening and loosening fastening devices 603. As can be seen from FIGS. 27A and B, a handheld tool inserted in direction 610 and rotated in direction 611 (and in reverse to direction 611)) tightens or loosens fastening devices 603 which extend through holes in mirror (or mirror-like) surface 602 (e.g., Miro-4 aluminum sheet available from Alanod-Westlake Metal IND., Ridgeville, Ohio, USA), lock nut 609, and into a complementary threaded hole of local visor housing 607; in Detail E of FIG. 27B this is illustrated as near emitting face 601 of LED lighting fixture 600C, though as can be seen from FIG. 27A, multiple locations can be identified and enabled with these adjustable local visoring means. In practice, selectively tightening fastening devices 603 uniformly across mirror surface 602—see arrows 610 and 611—results in a uniform deflection of mirror surface 602—see arrows 612—which results in a change in distance which in turn results in a uniform change to beam cutoff; alternatively, selective tightening of fastening devices non-uniformly across mirror surface 602—for example, by tightening individual fastening devices 603 nearest side surface 605 but not the other four illustrated in FIG. 27A—results in an angular deflection $\eta$ of mirror surface 602 which in turn results in an angular change to beam cutoff (e.g., to accommodate angled target areas such as curves or banks at a racetrack).

With respect to providing even greater beam control in the horizontal plane this is provided by combining mirror or mirror-like side surfaces 605—which, in practice, are glued to the inner surface of local visor housing 607 rather than bolted or riveted (as this would cause distortion in the beam)—having the same specular, thin (e.g., 0.06 in) Miro-4 aluminum sheet as surface 602, with blackened side surfaces 604 (e.g., with glossy (not matte) black paint). This is an improvement over light redirecting means described in aforementioned incorporated U.S. Pat. No. 10,378,732 insomuch that the present embodiment does not rely upon sharp or fragile glass and is less costly than coating glass to produce second surface mirrors, though of course, material choice or processing of materials could differ for local visoring. The position of side surfaces 604 and 605 will be dependent upon mounting location and direction of a driver (in the case of a racetrack). Blackened side surfaces 604 would be on the side of fixture 600C a driver is driving towards; this is because it has been found that blackened surfaces 604 will still reflect light at angles below 25 degrees incident to the plane of surface 604 (which is important for achieving light levels) but will absorb light at angles higher than 25 degrees incident (which is important for avoiding glare for a driver). It is anticipated knuckles 700 will still be adjusted horizontally such that light is projected no further than 15 degrees upstream of a driver and no further than 30 degrees downstream of a driver.

In practice, lighting fixtures 600C could be mixed and matched with lighting fixtures of other embodiments described herein to create a lighting system that addresses all the needs of difficult to light or non-standard target areas such as a racetrack. For example, system 1300 could be combined with system 1100 of Embodiment 2 by stacking arrays of lighting fixtures 600C on top of arrays of lighting fixtures 600A/B by mating pole sections 501, or by mixing lighting fixtures 600A, 600B, and 600C within a single array (i.e., sharing a common crossarm assembly 300). Given the labor-intensive nature of individually tightening and/or loosening apparatuses 603/609 so to provide precise LED lighting (even though some time is saved insomuch that optional steps 2007 and 2008 from method 2000 (later discussed) are omitted), it may be preferable to take this mix-and-match approach and preserve use of lighting fixtures 600C for very difficult to light or non-standard portions of said target area (e.g., tight turns, pit road).

Embodiment 4 may be preferable in situations where (i) any amount of glare or spill light in the aerial space above the lighting fixtures is undesirable, and (ii) existing pole locations are so far apart that there are gaps in lighting uniformity and it is desirable to spread out light in the horizontal plane from individual lighting fixtures so that the composite beam formed therefrom is smoothed out (i.e., perceivable dark and bright spots are minimized).

F. Exemplary Apparatus Embodiment 5

A fifth embodiment in accordance with at least one aspect of the present invention envisions Embodiment 4 modified to accommodate a difficult to light or non-standard target area that requires additional adjustability at the local visoring level to further increase beam control (here, to contain the beam at both the top and bottom of the vertical plane via a local visor assembly so to increase maximum candela across a narrower band (rather than lose any light outside and/or below said band)). As can be seen from FIGS. 28-35, system 1400 according to the present embodiment is similar to that of Embodiment 4 but with different fixtures 600 (here, a specific configuration 600D).

LED lighting fixture 600D includes LED light source assembly 800 to provide light direction means, and provides a first stage, local light redirection with no remote light redirection (as in Embodiment 4), but here local light redirection occurs on four surfaces and at one additional device (as opposed to three surfaces in Embodiment 4). Here, local visor housing 607 is four-sided and having a bottom mirror or mirror-like surface 608 with apparatuses 603/609; surface 608 is of the same material (here, Miro-4 aluminum sheet) and having the same adjustment functionality as surface 602 (though it could be Miro-4 aluminum sheet that has been blackened as is surface 604). As designed, the upper portion of local visor housing 607 extends 1½ degrees above an aiming direction (here, horizontal) and the bottom portion of local visor housing 607 extends 6 degrees below horizontal (see FIGS. 34 and 35) at its distal end because, for the specific example of light source (e.g., approximately one hundred-nine LEDs arranged in seven rows) and length of local visor (e.g., on the order of thirty-six inches as measured from the LED mounting surface of heat sink 606 to the distal end) presented herein, this results in colocating the photometric and geometric center of the composite beam projected from fixture 600D—which is very beneficial in providing precise LED lighting as it ensures the majority of light is useful (i.e., directed to a target area and not generally producing glare or spill light) when the fixture is aimed as intended. Additionally, LED lighting fixture 600D includes a distal, adjustable, blackened local visor 617 at emitting face 601 which can be moved upward out of the beam projected by the fixture or downward into the beam projected by the fixture to provide additional beam cutoff, absorb any stray light, or minimize striations which might occur from having multiple rows of LEDs. This can be done uniformly across apertures 618/fastening devices 619 to absorb light across a line perpendicular to an aiming axis of the lighting fixture, or non-uniformly across an angled line by lowering one side of visor 617 more than the opposite side (e.g., to accommodate angled target areas such as curves or banks at a racetrack). Again, given the labor-intensive nature of individually tightening and/or loosening apparatuses 603/609 so to provide precise LED lighting (even though some time is saved insomuch that optional steps 2007 and 2008 from method 2000 are omitted), it may be preferable to take this mix-and-match approach and preserve use of lighting fixtures 600D for very difficult to light or non-standard portions of said target area.

Embodiment 5 may be preferable in situations where any amount of glare or spill light in the aerial space above the lighting fixtures is undesirable but it is also desirable that no light be directed near the pole base (e.g., it would not be useful light or it is critical to direct all possible light output to a narrow band or there is an object near the pole base which should not be illuminated (e.g., doing so would cause glare)).

G. Exemplary Method

As envisioned, all configurations of precise LED lighting systems 100, 1100, 1200, 1300, 1400 are at least partially factory aimed where such is available, and shipped to a site with individual parts in the described assemblies already at least partially assembled (e.g., any weldments between parts in assembly 500 completed prior to shipping assembly 500 to the site). As such, a method 2000 of onsite assembly and installation of a precise LED lighting system according to aspects of the present invention comprises a first step 2001 of taking each individual assembly (e.g., 200, 300, 400, 500, 600, 700, and/or 1000 depending on the embodiment) and assembling them together on or near the ground so to create system 100, 1100, 1200, 1300, or 1400 (or any combination thereof if combining fixtures or portions of different embodiments). As envisioned, this comprises slip-fitting, bolting, twisting, etc. of parts with hand tools—anything more invasive or requiring heavy equipment (e.g., welding) is likely completed at the factory prior to shipping (though, of course, this could differ). A second step 2002 comprises setting an initial aiming angle of one or more parts. As previously discussed, as envisioned each lighting fixture 600 is enabled with an adjustable knuckle assembly 700 so to allow for a wide range of horizontal aiming (i.e., left and right panning) and vertical aiming (i.e., up and down tilting); setting knuckle aiming angles is one example of a part which could be aimed according to step 2002. If desired, fixtures 600 could even be "snapped" into a factory set horizontal aiming position when a crossarm half of knuckle assembly 700 is mated with a corresponding plate mounted to or a part of crossarm assembly 300, the position of which is pre-set at the factory; U.S. Pat. No. 8,337,058 incorporated by reference herein in its entirety discusses one such plate design and corresponding aiming method. In this sense fixtures 600 are initially aimed by snapping knuckle 700 into its factory designated position on crossarm assembly 300, but additional aiming (e.g., of local visoring, of remote visoring, or both local and remove visoring) could be later performed at step 2006.

Figure 17:
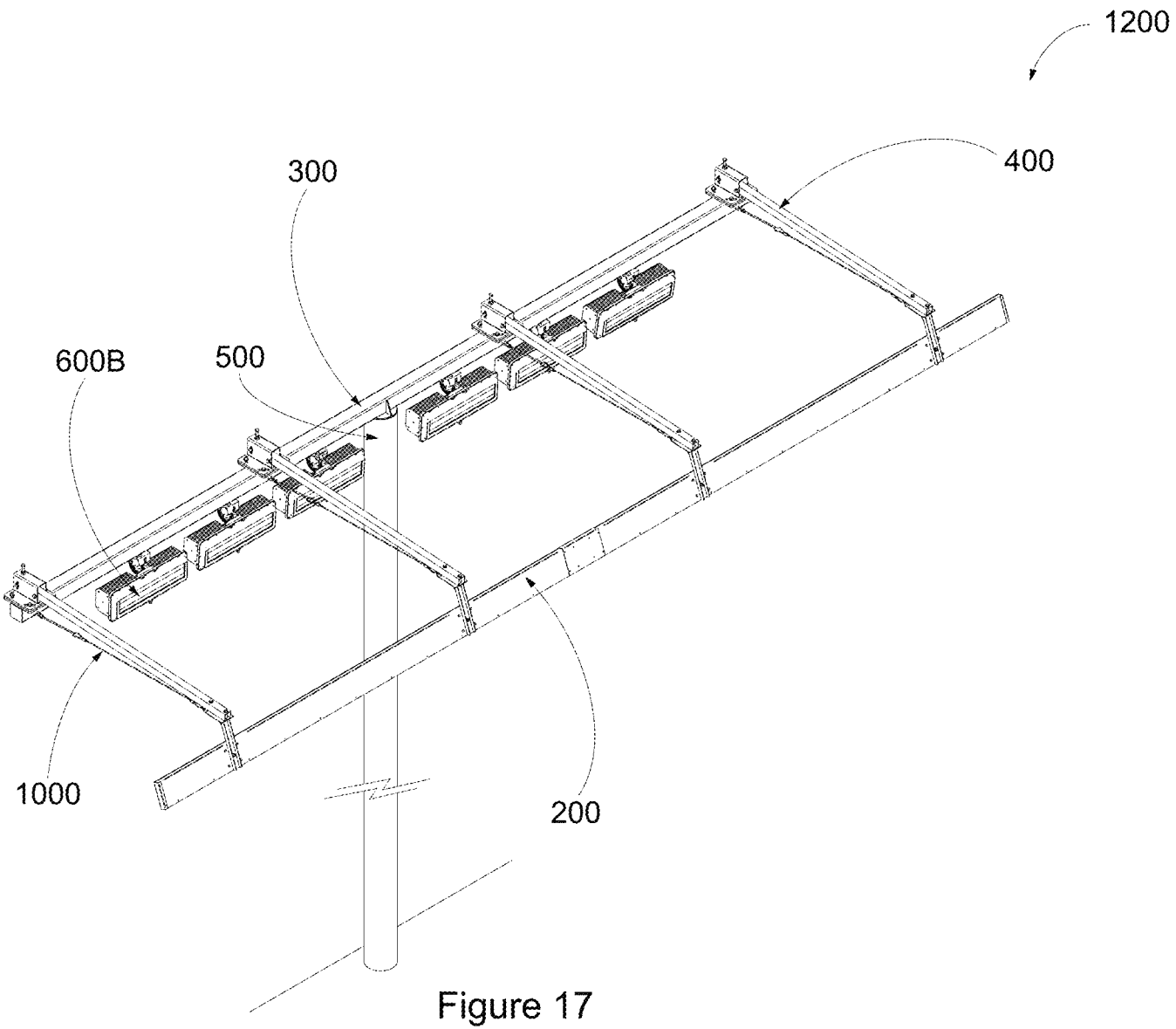
FIG. 17 illustrates a top front perspective view of a third embodiment to provide precise LED lighting according to aspects of the present invention; here, using remote visoring only in a ground-mounted configuration, with double break lines indicating variable length. Note that six lighting fixtures with associated knuckles are illustrated, though this is by way of example and not by way of limitation in terms of both quantity and design.
Figure 18:
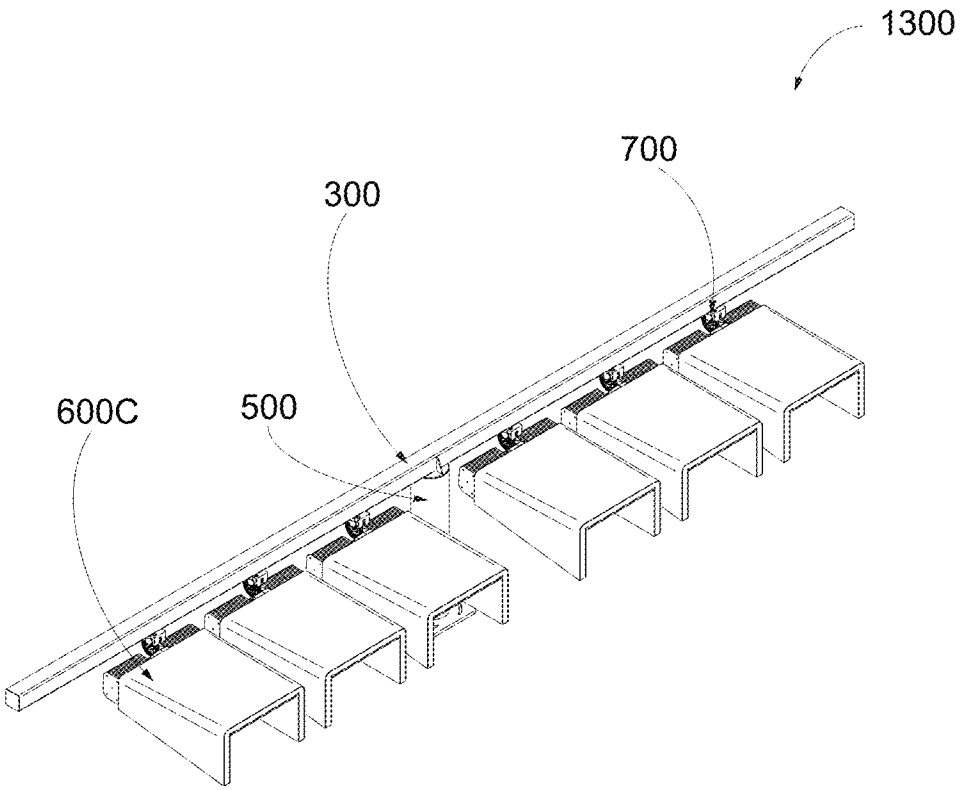
FIG. 18 illustrates a top front perspective view of a fourth embodiment to provide precise LED lighting according to aspects of the present invention; here, using local visoring only. Note that six lighting fixtures with associated knuckles are illustrated, though this is by way of example and not by way of limitation in terms of both quantity and design.
Figure 19:
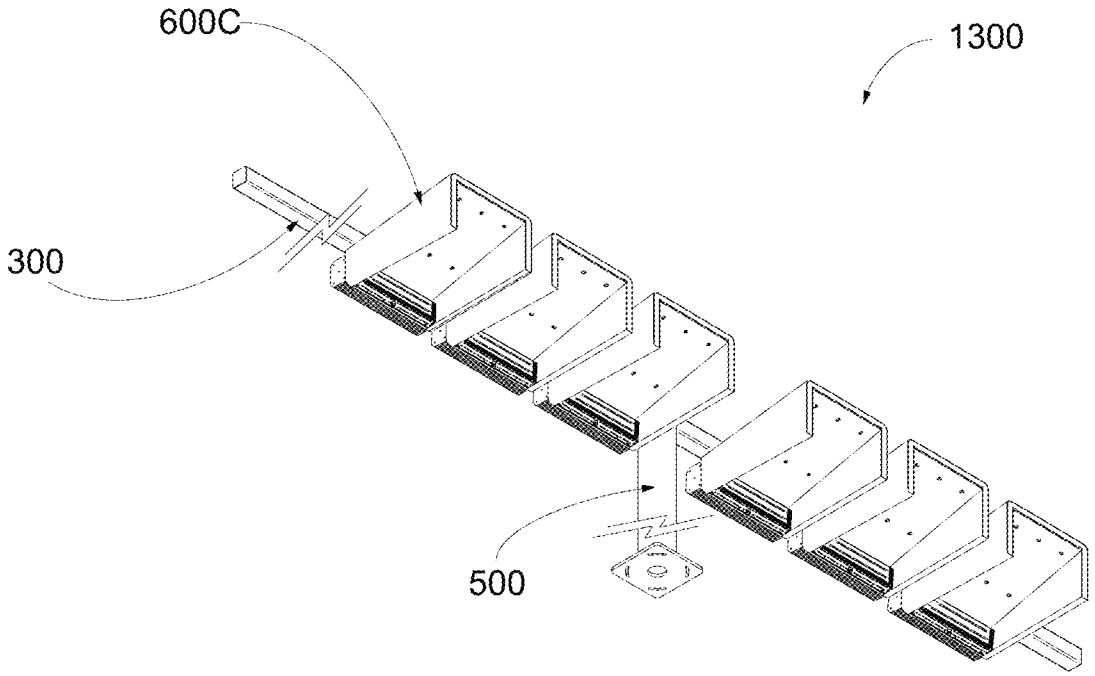
FIG. 19 illustrates a bottom front perspective view of FIG. 18; here, with double break lines indicating variable lengths. It is of note double break lines have been omitted from FIGS. 18, and 20-25 for clarity.
Figure 20:
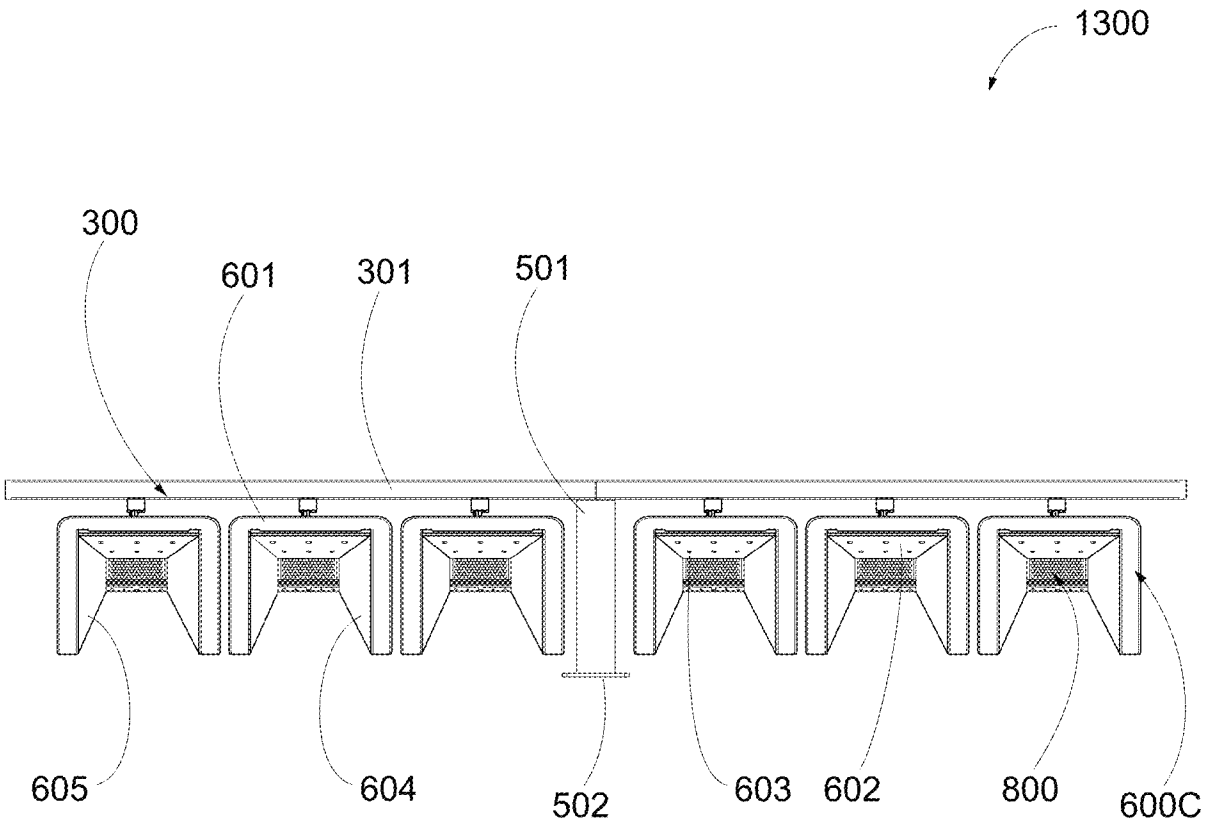
FIG. 20 illustrates a front view of FIG. 18.
Figure 21:
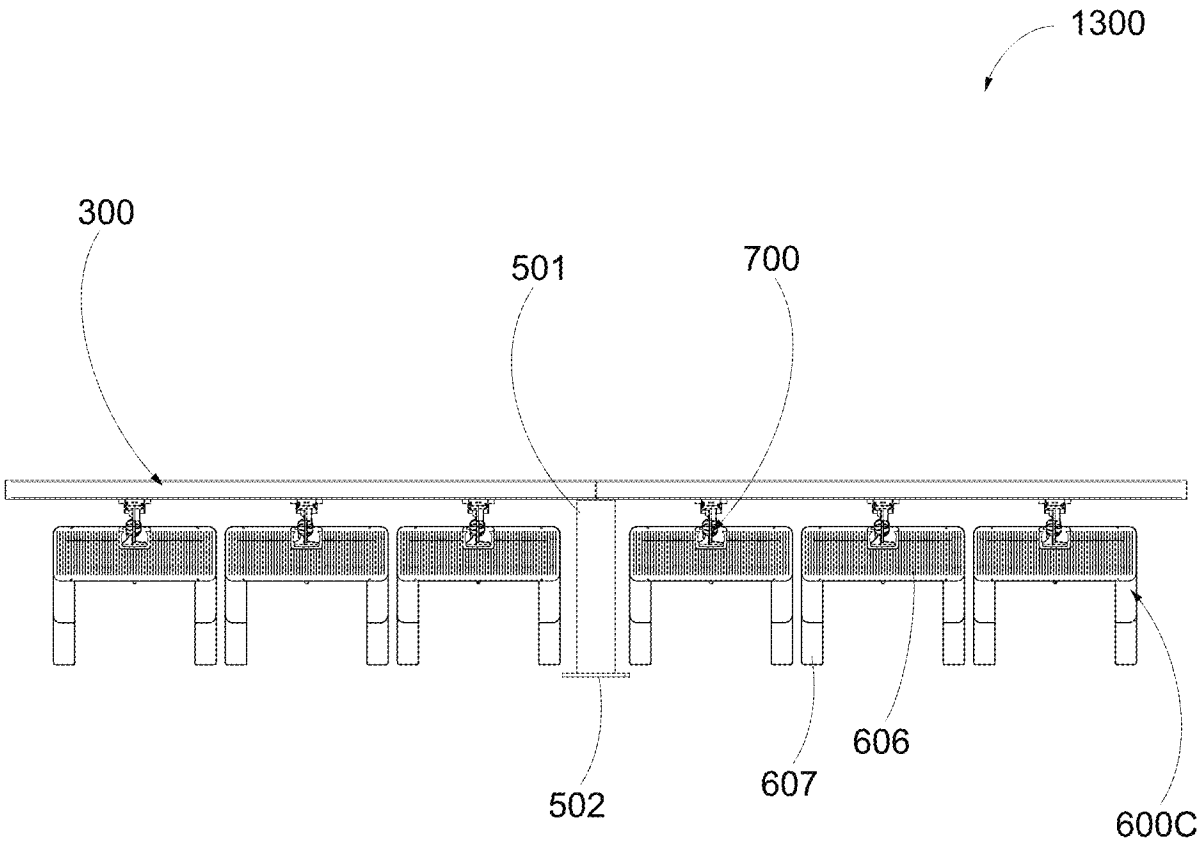
FIG. 21 illustrates a back view of FIG. 18.
Figure 22:
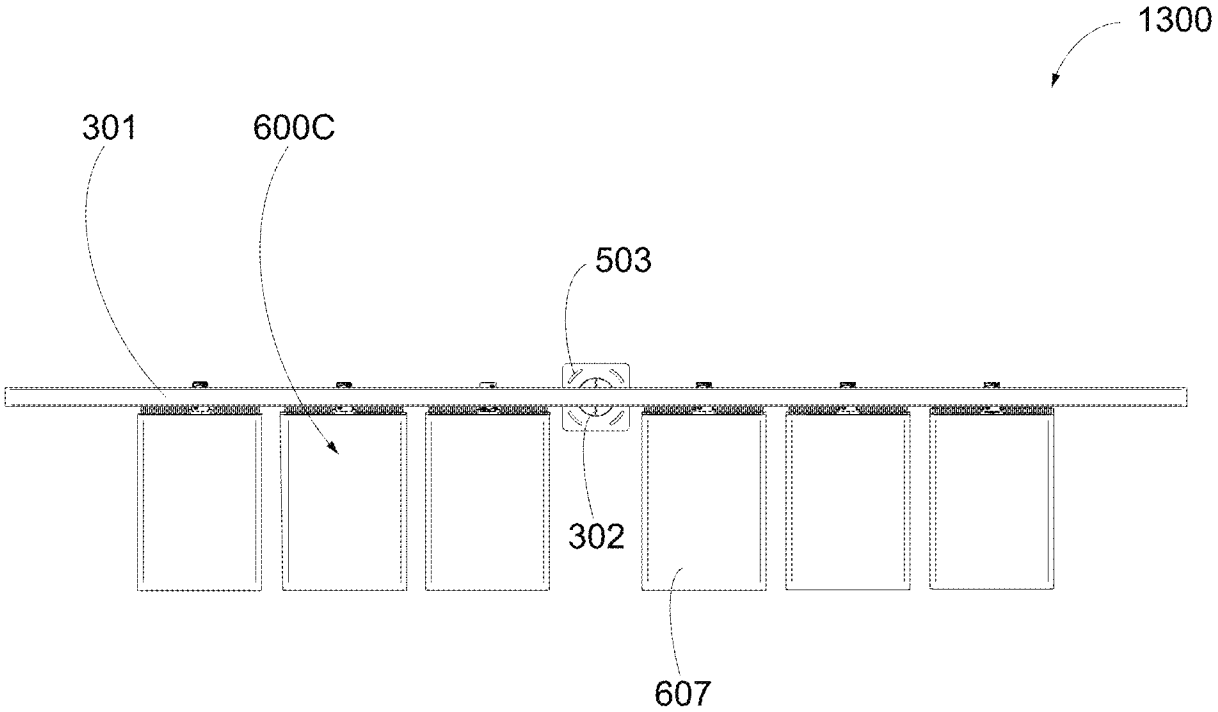
FIG. 22 illustrates a top view of FIG. 18.
Figure 23:
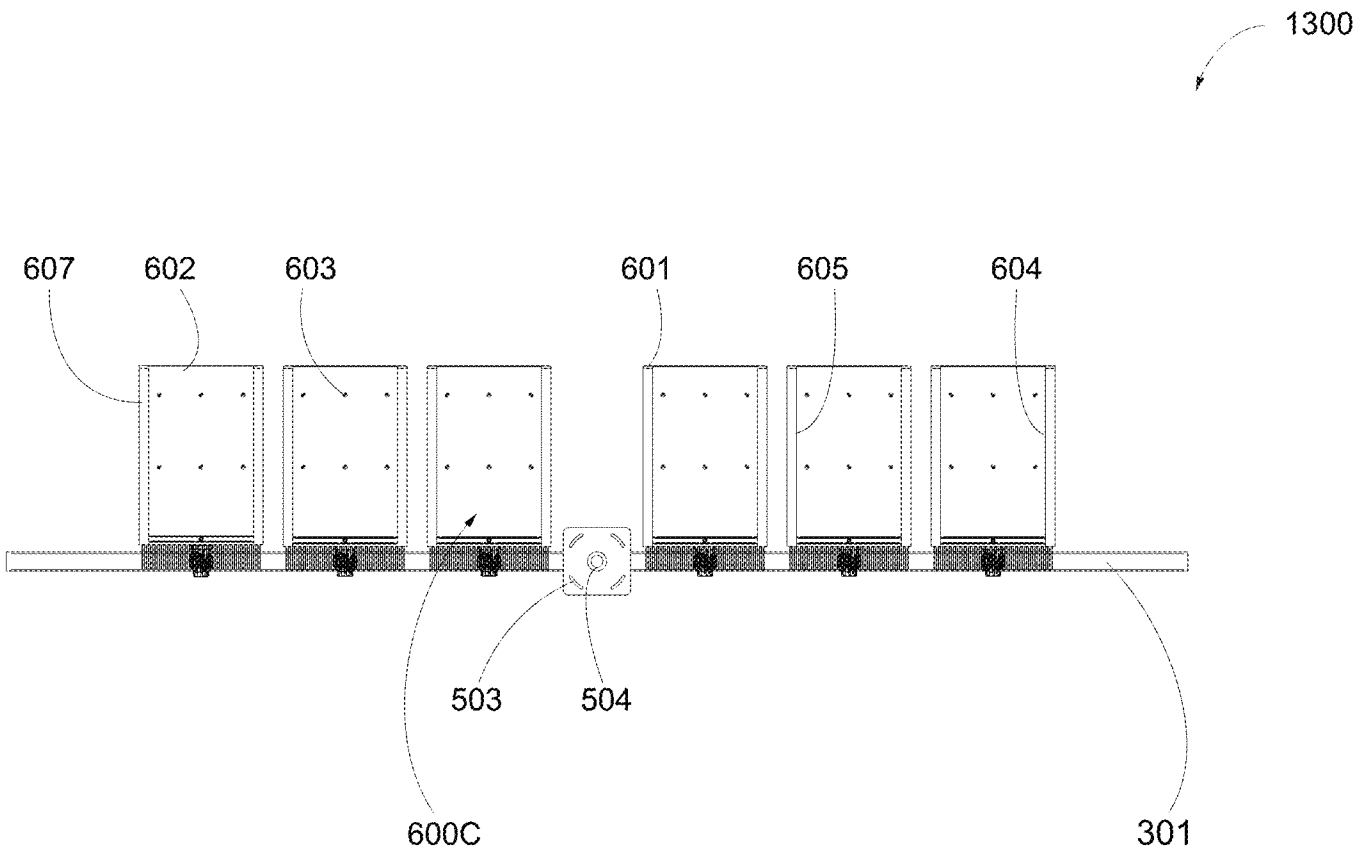
FIG. 23 illustrates a bottom view of FIG. 18.
Figure 24:
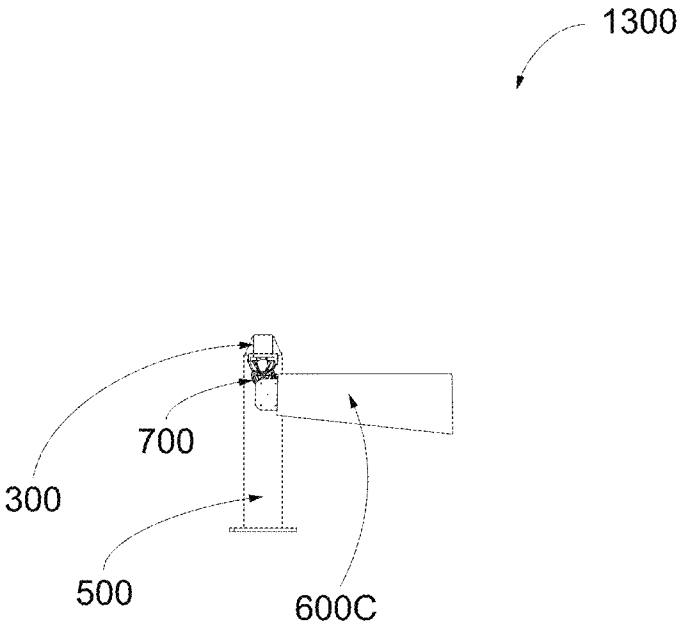
FIG. 24 illustrates a left side view of FIG. 18.
Figure 25:
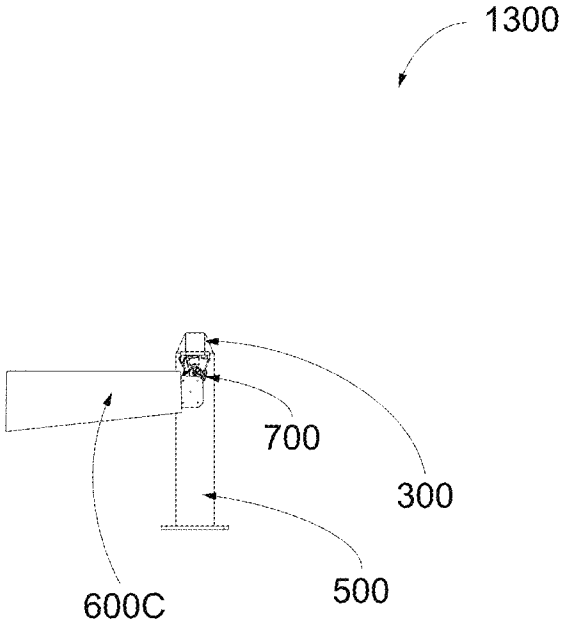
FIG. 25 illustrates a right side view of FIG. 18.

Once preliminary aiming is complete, system 100, 1100, 1200, 1300, and/or 1400 is lifted (e.g., via crane) according to step 2003 and preliminarily set on a pole, pole base, or in a hole in the ground (see FIG. 17 for a ground-mounted example). The entire system may be pivoted about an axis extending along the length of support structure assembly 500 (e.g., with crane support)—in accordance with an aiming diagram of the lighting design (see again incorporated U.S. Pat. No. 7,500,764)—until a correct orientation of the pole relative to the target area is achieved. To complete step 2004, system 100, 1100, 1200, 1300, and/or 1400 is positionally affixed in its correct operational orientation; via come-alongs securing slip-fit pole sections, via anchors or other fastening devices through apertures 503 and into a pole base, or backfilling or otherwise securing a pole section 501 in the ground, for example.

At this point, system 100, 1100, 1200, 1300, and/or 1400 is ready to be powered according to step 2005; it is important to power fixtures 600 before final aiming for more effective fine tuning of the composite beams. In practice, step 2005 may include such things as internally routing wiring out the back side of fixtures 600 into knuckles 700, into crossarm assembly 300, down support structure assembly 500, and landing at the relevant power means (e.g., drivers located in enclosures mounted to support structure assembly 500). As envisioned, parts 700, 300, and 500 are at least partially hollow to ensure wiring is internally routed and not exposed to the elements (e.g., for an outdoor racetrack application). Of course, step 2005 could include any number of additional steps as needed to provide sufficient electrical power to fixtures 600 (e.g., trenching and laying power lines to support structure assembly 500).

Once powered, fixtures 600 will project light more-or-less in the correct direction with the composite beam more-or-less having the desired degree of cutoff and control. However, an important step 2006 comprises final aiming of fixtures 600. According to step 2006, local visoring (if present) is set at the desired vertical aiming angle as previously described; this could be done via knuckle 700, apparatuses 603/609, parts 617/618/619, pivoting of local visor housings (see again incorporated U.S. Pat. No. 10,378,732), or some combination thereof. If desired and present, stabilizing assembly 1000 and remote visor assembly 200 may be slightly pivoted up and out of the composite beam (e.g., via adjustable support assembly 400) so to better evaluate local visoring according to step 2006. Again, the precise vertical aiming angle could be the same for each fixture or different, and will depend upon the desired sharpness of cutoff, beam control, and characteristics of the site and the target area itself. For the aforementioned example of a racetrack, a number of factors such as pole height, pole setback, driving direction, type of vehicle/driver height, and the like may impact the aiming angle, but for a pole height of 15-50 feet, a setback of 150-400 feet, a motorsport, and each fixture designed to be aimed to the driving line and illuminate approximately half a track, a shallow vertical aiming angle (as compared to state-of-the-art practices) on the order of 4 degrees down from horizontal may be reasonable (if using Embodiment 1).

If desired (e.g., if remote visor assembly 200 was pivoted away during step 2006), remote visoring may be set in a vertical plane (e.g., via devices 405, 407, 408, and 409) in accordance with optional step 2007. In practice, this again will depend on a number of factors (including whether or not remote visoring is present), but for the same scenario just described, would be on the order of 1-3 degrees down from horizontal. Likewise, a final optional step 2008 comprises final aiming of remote visor assembly 200 in a horizontal plane (e.g., via devices 303, 305, 403, and 404)—for the scenario just described, to fine tune light projected upstream of a driver. Again, steps 2007 and 2008 may be different (or omitted) depending on the combination of lighting fixtures 600 and light redirecting means described herein (all of which could be combined in a number of ways and quantities).

H. Options and Alternatives

The invention may take many forms and embodiments. The foregoing examples are but a few of those. To give some sense of some options and alternatives, a few examples are given below.

Precise LED lighting systems 100, 1100, 1200, 1300, and 1400 have been described and illustrated as including a variety of light redirecting means via local and/or remote visoring means (which could be reflective or blackened or otherwise at least partially light absorbing depending on need), but all have been described as including the same light source and light directing means (see FIG. 26). It is important to note that light sources may be other than LEDs (e.g., laser), light directing means may be other than as illustrated (e.g., individual acrylic secondary lenses with individual holders), light directing means could be omitted altogether, light redirection means could exhibit a range of redirection properties (e.g., partially absorbing light, fully absorbing light, specular reflection, diffuse reflection) depending on processing and/or finish of parts, or fixtures 600 themselves may include additional or different parts separate from (e.g., fixtures 600D might include a light transmissive glass sealed or otherwise positionally affixed at emitting face 601 to deter birds from nesting in local visor housing 607)—all are possible and envisioned alone or in different combinations according to aspects of the present invention.

Figure 38:
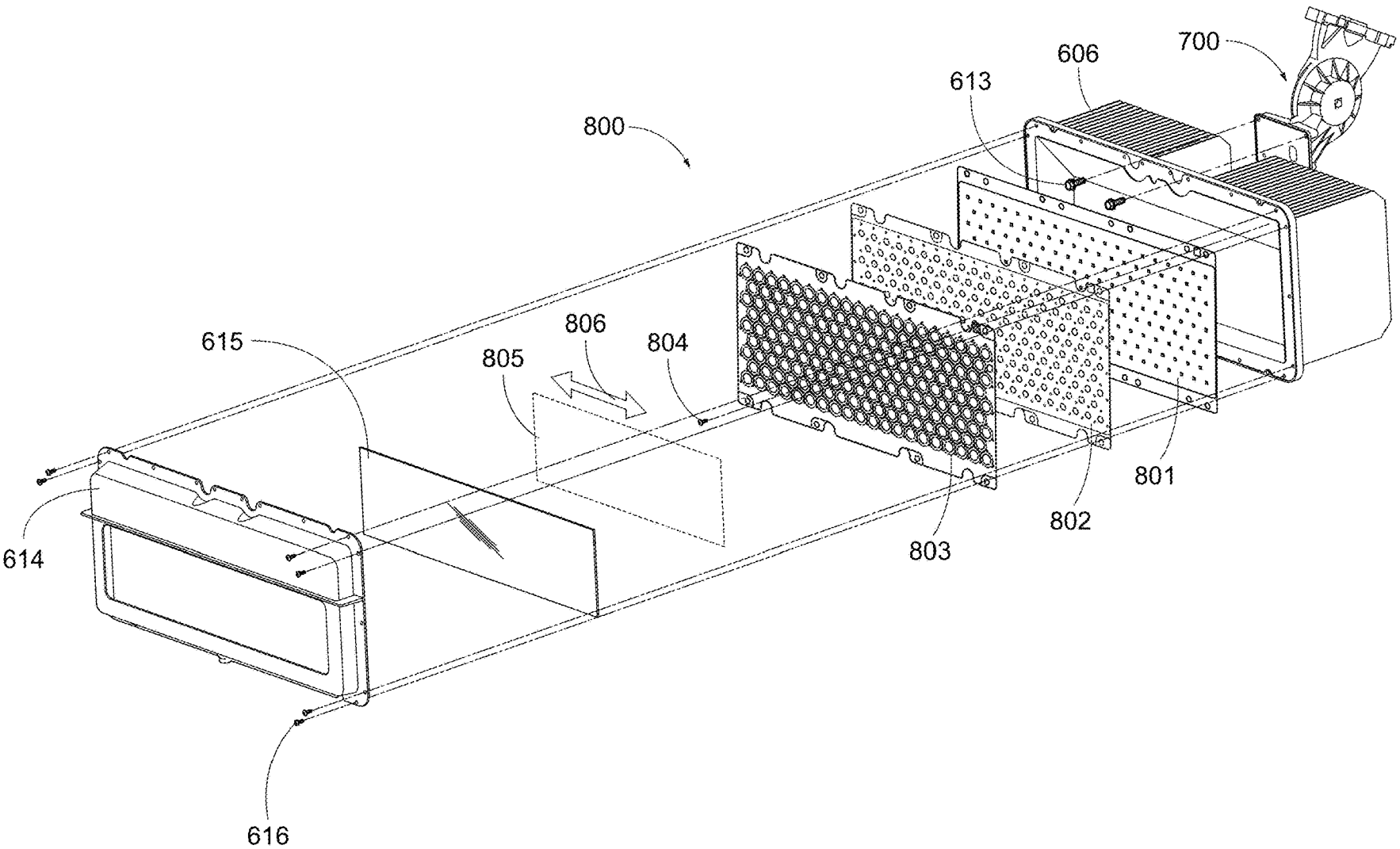
FIG. 38 illustrates FIG. 26 as modified to include additional light directing means (here, a diffuser in sheet form).
Figure 39A:
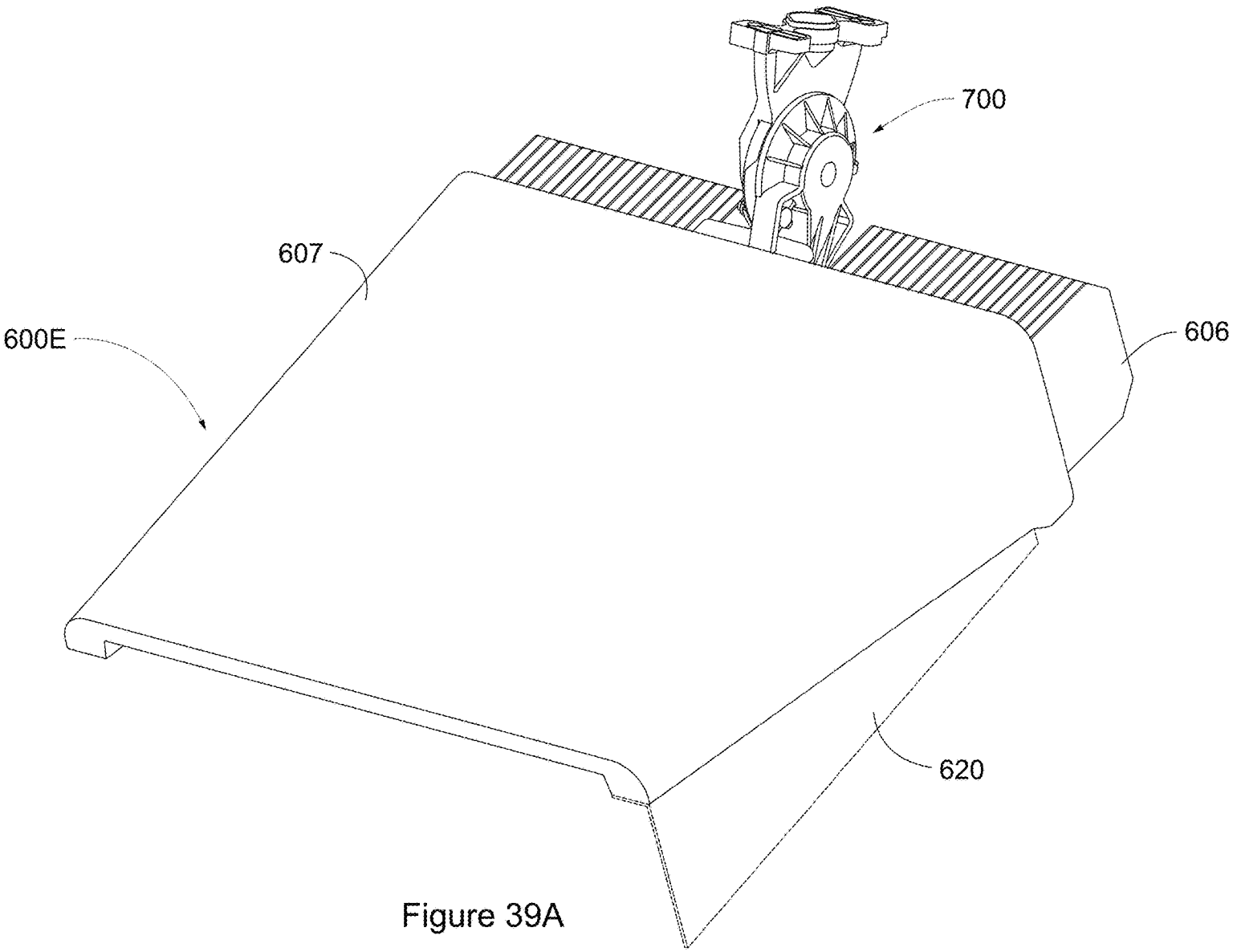
FIGS. 39A and B illustrate FIG. 38 as modified to include additional light redirecting means (here, a visor extension on one side of the local visor)
Figure 39B:
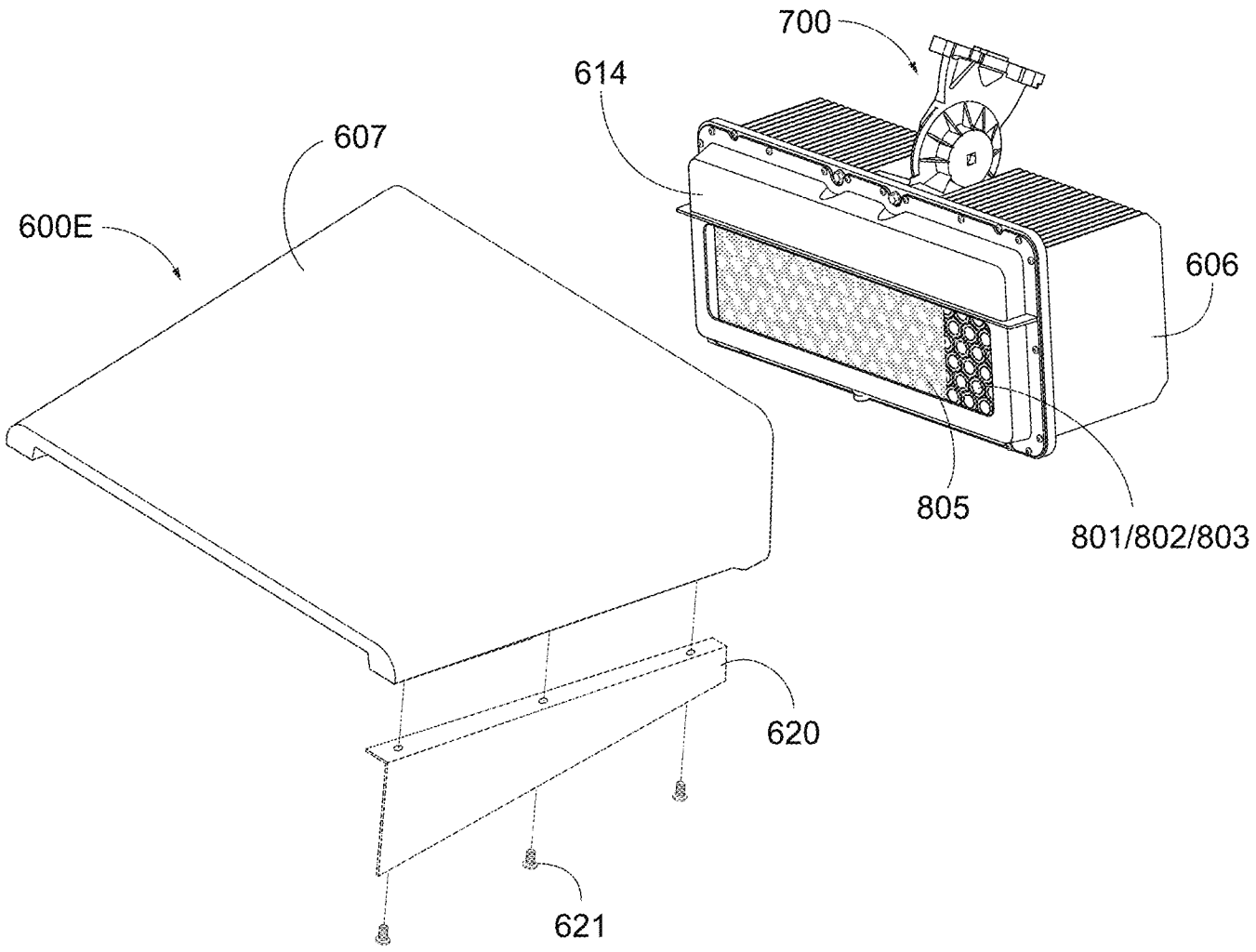

Two specific examples of additional and/or alternative light directing means and light redirecting means are illustrated in FIG. 38 and FIGS. 39A-B, respectively. As can be seen from FIG. 38, an optional diffuser 805 is selectively positioned (see diagrammatic arrow 806) over one or more columns of LEDs 801 with associated secondary lenses 802 so to diffuse light from a subset of light sources of LED light source array 800; this is particularly helpful in smoothing out just a portion of the beam from a fixture 600—effectively combining narrow beam and wider beam properties for optimized beam control—to minimize so-called "tiger stripes" which can occur when pole locations are so far apart that beams cannot be overlapped to create a desired level of uniformity in the composite beam. Here, diffuser 805 is a 40 degree horizontal by 0.2 degree vertical one-direction sheet (e.g., or any of light shaping diffuser sheets available from Luminit, Torrance, Calif., USA) which is glued or otherwise affixed to the inside of light transmissive glass 615 (i.e., the side of glass 615 facing the internal space of lighting fixture 600) once adequately positioned—see FIG. 39B for a non-limiting example—though diffusers could be independent devices or integrally formed with lenses 802. In practice, any design/configuration of lighting fixture 600 might employ optional diffuser 805—in such an instance either step 2002 or 2006 of method 2000 might be adjusted accordingly to accommodate positioning of the diffuser material. Of course, if lighting fixtures 600 are sealed at a factory prior to shipping, diffusers 805 might have to be installed prior to shipment, installed on the outside of glass 615, or lighting fixtures 600 left unsealed or sealed on site. FIGS. 39A and B illustrate a configuration of lighting fixtures 600 which employs optional diffuser 805 (here, a specific configuration 600E), and which also employs an optional local side visor extension 620 formed from the same material (here, Miro-4 aluminum sheet) producing specular reflection as has been described herein, though it could be peened or processed (e.g., Miro-9 aluminum sheet) to provide a more diffuse light; this is particularly helpful in ensuring a longer visor on the side of fixture 600E upstream of a driver (e.g., so light sources cannot be seen in a rearview mirror thereby producing glare), combined with a shorter visor on the opposite side of fixture 600E (i.e., downstream of a driver) so to project more light downstream, effectively adjusting the aiming of the composite beam in the horizontal plane without (or with very little) undesirable beam shift (i.e., shifting the physical location of maximum candela or photometric center or other defined value). Here, optional local side visor 620 is shown as affixed directly to local visor housing 607 via fastening devices 621, though this could differ; for example, optional local side visor 620 might be glued to a more rigid material prior to installation, or may be riveted or welded. In practice, optional local side visors 620 might be installed prior to shipping lighting fixture 600E or, if having removable fastening devices such as is illustrated, might be installed on site—in such an instance step 2007 of method 2000 might be modified accordingly to also include final placement of local visors.

With further respect to options and alternatives, knuckles 700 could differ from those illustrated, referenced, and described herein; for example, knuckles 700 may simply be static mounts with no adjustability (which may require different horizontal and vertical aiming functionality/range in other parts), or knuckles may have additional, third axis adjustability; the latter is described in U.S. Pat. No. 8,789,967 incorporated by reference herein in its entirety. Still further, remote visoring 200 may include reflective portions, peened portions, or otherwise not be painted or coated black (or, alternatively, completely painted or coated black); in essence, light redirecting means could be light absorbing, light blocking, or light reflecting at the remote level in addition to or in opposition to at the local level. Further still, support structure assembly 500 could differ in not only length but method of attachment (e.g., slip-fit, bolt-on, tenon mount, etc.)—this is likewise true of other parts (e.g., surfaces 604/605 could be taped rather than glued). Support structure assembly 500 may not even include poles—for example, scaffolding (e.g., for a building or catwalk mounting application) could be used. Also, quantity, sizing, and material of any of the aforementioned parts could differ; this is indicated in both the figures (e.g., by double break lines in FIGS. 2 and 18, by the variety of materials in FIGS. 12A-14B), and indicated in the description (e.g., assemblies 200 and 400 being formed from lightweight aluminum alloy and assemblies 300 and 500 being formed from structural steel, more or fewer apparatuses 603/609 in a fixture 600 than is illustrated). All of the aforementioned are possible, and envisioned.

Precise LED lighting systems 100, 1100, 1200, 1300, and 1400 have been described and illustrated as providing lighting for difficult to light applications or non-standard target areas (retrofit or otherwise); racetrack and baseball lighting applications have been given as examples. It is important to note that lighting applications may differ from those described herein and may not be difficult to light or include non-standard target areas, or be retrofits. Precise LED lighting systems 100, 1100, 1200, 1300, and 1400 might include additional provisions for outdoor applications such as racetrack and baseball lighting; for example, parts could be painted or anodized to provide corrosion resistance, parts could be sized to prevent oscillation or movement in the event of wind, or even include noise-dampening elements (e.g., rubber buffers where portions of stabilizing assembly 1000 abut adjustable support assembly 400). All of the aforementioned are possible, and envisioned.

Lastly, while one possible method for onsite assembly and installing precise LED lighting systems 100, 1100, 1200, 1300, and 1400 has been illustrated and discussed, it is important to note that in practice method 2000 may include more, fewer, or different steps and not depart from at least some aspects of the present invention. For example, since there is selectivity in horizontal aiming of the remote visoring (e.g., at the proximate end, at the distal end, individually or across a whole span of remote visors), method 2000 might include multiples of step 2008 at different points in the method instead of only a final adjustment—this is likewise true where there are multiple options for local visoring. Step 2007 could be omitted if remote visor assembly 200 was never pivoted out of position. Step 2003 could occur before step 2002. In some situations there may not be an opportunity to aim parts or even affix parts in a factory setting, and so method 2000 may be expanded (e.g., to include additional onsite aiming and fastening or otherwise joining of parts). Method 2000 could even be expanded to consider combining installation of precise LED lighting systems 100, 1100, 1200, 1300, and/or 1400 with general purpose or state-of-the-art lighting system so to, for example, provide lighting across an entire racetrack from approximately opposite mounting positions (e.g., systems 100, 1100, 1200, 1300, and/or 1400 on the inside of the track and more traditional lighting on the outside of the track)—to supplement light levels to allow for televised events, or simply for retrofit purposes, for example. All of the aforementioned are possible, and envisioned.

The invention claimed is:

1. A method of installing a precise LED lighting system with sharper cutoff and increased beam control as compared to general purpose lighting at a target area comprising:

a. shipping to a site a plurality of lighting assemblies, each lighting assembly comprising:
   i. a support structure assembly;
   ii. a crossarm assembly adapted for mounting to the support structure assembly;
   iii. a plurality of knuckle assemblies adapted for mounting to the crossarm assembly; and
   iv. a plurality of LED lighting fixtures adapted for mounting to the crossarm assembly via the knuckle assemblies, each of the LED lighting fixtures comprising a plurality of LED light sources and at least one of:
      1. Local light directing means;
      2. Local visoring means; or
      3. remote visoring means;

b. assembling at or near a ground level of the site the plurality of lighting assemblies to create an initial version of the precise LED lighting system;

c. lifting the initial version of the precise LED lighting system onto a base;

d. orienting the initial version of the precise LED lighting system on the base towards the target area;

e. securing the initial version of the precise LED lighting system to the base; and f adjusting at least one of the local light directing means, local visoring means, or remote visoring means of the precise LED lighting system relative to the target area to create a final precise lighting system and provide precise lighting at the target area;

wherein the remote visoring means includes an adjustable stabilizing assembly for mounting to the crossarm assembly having a proximate end at the support structure assembly and LED lighting fixtures and a distal end away from the support structure assembly and LED lighting fixtures.

2. The method of claim 1 wherein the local light directing means comprise any of:

a. a knuckle of the knuckle assembly adjustable in at least one plane;

b. one or more secondary lenses associated with the plurality of LED light sources; or c. a diffuser.

3. The method of claim 2 further comprising a step of adjusting at least one of the local light directing means prior to lifting the initial version of the precise LED lighting system onto a base.

4. The method of claim 1 wherein the step of adjusting at least one of the local light directing means, local visoring means, or remote visoring means of the precise LED lighting system relative to the target area comprises adjusting local visoring means or remote visoring means in one or more of a vertical plane and a horizontal plane.

5. The method of claim 4 wherein the local visoring means comprises one or more reflective visors, and wherein the step of adjusting the local visoring means comprises adjusting one or more devices associated with the one or more reflective visors to produce a selective deflection of the one or more reflective visors to provide an adjustable sharper cutoff.

6. The method of claim 4 wherein the local visoring means comprises one or more blackened or at least partially light absorbing visors, and wherein the step of adjusting the local visoring means comprises adjusting one or more devices associated with the one or more blackened or at least partially light absorbing visors upward or downward.

7. The method of claim 1 wherein the step of adjusting at least one of the local light directing means, local visoring means, or remote visoring means of the precise LED lighting system relative to the target area comprises adjusting local visoring means and remote visoring means in one or more of a vertical plane and a horizontal plane.

8. The method of claim 7 wherein the local visoring means comprises an adjustable, blackened local visor at an emitting face of an LED lighting fixture and wherein the step of adjusting the local visoring means comprises adjusting the blackened local visor in a vertical plane to provide an adjustable sharper cutoff.

9. The method of claim 1 wherein the remote visoring means comprise:

one or more remote visors at or near the distal end of the adjustable stabilizing assembly; and wherein the step of adjusting at least one of the local light directing means, local visoring means, or remote visoring means of the precise LED lighting system relative to the target area comprises adjusting the adjustable stabilizing assembly in one or more of a vertical plane and a horizontal plane to facilitate adjustment of the one or more remote visors into or out of the composite beam of the LED lighting fixtures to provide sharper cutoff or increased beam control.

10. The method of claim 1 wherein the support structure assembly, the crossarm assembly, and the plurality of knuckle assemblies are at least partially hollow, and wherein the method of claim 1 further comprises routing wiring from the plurality of LED lighting fixtures through an internal space formed by the hollow in the support structure assembly, crossarm assembly, and plurality of knuckle assemblies to a power source and powering the plurality of LED lighting fixtures prior to creating the final precise lighting system.

11. A precise LED lighting system with sharper cutoff and increased beam control as compared to general purpose lighting adapted to light a target area comprising:

a. a support structure assembly;

b. a crossarm assembly mountable to the support structure assembly;

c. a plurality of knuckle assemblies mountable to the crossarm assembly;

d. a plurality of LED lighting fixtures mountable to the crossarm assembly via the knuckle assemblies, each LED lighting fixture comprising:

i. a heat sink;

ii. a housing with an emitting face and an opening in the emitting face into an internal space of the LED lighting fixture;

iii. a light transmissive glass sealed against the emitting face;

iv. a plurality of LED light sources;

v. a plurality of secondary lenses associated with the plurality of LED light sources; and vi. an optics holder to hold the LED light sources together with the secondary lenses in their correct operational orientation in the internal space of LED lighting fixture; and e. a remote visoring assembly that is mountable to the crossarm assembly and adjustable in two planes via an adjustable support having a proximate end at the support structure assembly and LED lighting fixtures and a distal end away from the support structure assembly and LED lighting fixtures.

12. The LED lighting system of claim 11 wherein each knuckle assembly is associated with one LED lighting fixture, and wherein each knuckle assembly is adapted to permit pivoting of its associated said LED lighting fixture in at least two planes.

13. The LED lighting system of claim 11 further comprising diffuser that is in the form of a sheet applied to the light transmissive glass.

14. The LED lighting system of claim 11 further comprising local visor assembly that comprises an adjustable light reflecting surface or an at least partially light absorbing surface at or near an associated said LED lighting fixture.

15. The LED lighting system of claim 14 wherein the adjustable light reflective surface is adjustable via one or more devices which produce a selective deflection of the light reflecting surface.

16. The LED lighting system of claim 15 wherein both the light reflecting surface and the at least partially light absorbing surface are adjustable.

17. The LED lighting system of claim 11 further comprising local visor assembly that comprises both a light reflecting surface and an at least partially light absorbing surface at or near an associated said LED lighting fixture.

18. The LED lighting system of claim 11 further comprising a light redirecting surface disposed at or towards the distal end that is adjustable into the composite beam of the LED lighting fixtures.

19. The LED lighting system of claim 11 wherein the support structure assembly comprises a pole assembly, and wherein the crossarm assembly comprises a plurality of crossarms and a fitter assembly mountable to the pole assembly to stack a subset of the plurality of LED lighting fixtures above another subset of the plurality of LED lighting fixtures.

20. A precise LED lighting system comprising:

a. a support structure assembly;

b. a crossarm assembly mounting to the support structure assembly;

c. a plurality of LED lighting fixtures;

d. a knuckle assembly adjustably mounting each of the LED lighting fixtures to the support structure, the knuckle assembly adjustable in at least two planes; and e. a remote visor assembly associated with each of the plurality of LED lighting fixtures;

wherein the remote visor assembly comprises an adjustable support having a proximate end at the support structure assembly and LED lighting fixtures to a distal end away from the support structure assembly and LED lighting fixtures.

21. The LED lighting system of claim 20 wherein each knuckle assembly is adjustable in three planes.

22. The LED lighting system of claim 20 further comprising local visor assembly that comprises at least one of:

a. an adjustable light reflecting surface at or near the LED lighting fixture, the adjustable light reflecting surface adjustable via one or more devices which produce a selective deflection of the light reflecting surface;

b. an at least partially light absorbing surface at or near the LED lighting fixture, the at least partially light absorbing surface at a fixed angle relative to an aiming direction; or c. an adjustable at least partially light absorbing surface at a distal end of a visor housing of the LED lighting fixture, the adjustable at least partially light absorbing surface adjustable via one or more devices which allow movement of the adjustable at least partially light absorbing surface into the composite beam of the LED lighting fixture.

23. The LED lighting system of claim 20 wherein the remote visor assembly comprises a light redirecting surface disposed at or towards the distal end of the remote visor assembly that is adjustable to be positioned into the composite beam of the LED lighting fixtures.

24. The LED lighting system of claim 23 wherein the remote visor assembly further comprises a stabilizing assembly between the support structure assembly and the adjustable support to stabilize the light redirecting surface of the remote visor assembly.

25. The LED lighting system of claim 24 wherein the stabilizing system includes both resilient and rigid means.

* * * * *